US011312130B2

(12) United States Patent
Hagiwara et al.

(10) Patent No.: US 11,312,130 B2
(45) Date of Patent: Apr. 26, 2022

(54) LIQUID EJECTING HEAD AND LIQUID EJECTING APPARATUS

(71) Applicant: SEIKO EPSON CORPORATION, Tokyo (JP)

(72) Inventors: Hiroyuki Hagiwara, Matsumoto (JP); Katsuhiro Okubo, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 4 days.

(21) Appl. No.: 16/806,405

(22) Filed: Mar. 2, 2020

(65) Prior Publication Data

US 2020/0282721 A1 Sep. 10, 2020

(30) Foreign Application Priority Data

Mar. 4, 2019 (JP) ..... JP2019-038548

(51) Int. Cl.
*B41J 2/045* (2006.01)

(52) U.S. Cl.
CPC ..... *B41J 2/04563* (2013.01); *B41J 2/0458* (2013.01); *B41J 2/04581* (2013.01)

(58) Field of Classification Search
CPC ..... B41J 2/04563
See application file for complete search history.

(56) References Cited

U.S. PATENT DOCUMENTS 5,489,930 A * 2/1996 Anderson ..... B41J 2/17563 210/488
2007/0229596 A1* 10/2007 Chikamoto ..... B41J 2/14209 347/50
2010/0165023 A1* 7/2010 Suzuki ..... B41J 2/18 347/10
2012/0092408 A1* 4/2012 Yamamori ..... B41J 2/04531 347/17
2013/0194335 A1* 8/2013 Nodsu ..... B41J 2/1408 347/14
2013/0201248 A1* 8/2013 Owaki ..... B41J 2/14153 347/19
2019/0092003 A1* 3/2019 Mizuno ..... B41J 2/155

FOREIGN PATENT DOCUMENTS

JP 2015-107652 6/2015

* cited by examiner

*Primary Examiner* — Shelby L Fidler
(74) *Attorney, Agent, or Firm* — Workman Nydegger

(57) ABSTRACT

A liquid ejecting head including: a first liquid ejecting portion configured to eject a liquid; a second liquid ejecting portion configured to eject a liquid; a first supply flow path configured to supply the liquid to the first liquid ejecting portion and the second liquid ejecting portion; and a temperature detection element for measuring a temperature of the liquid. The first supply flow path includes a common portion to which the liquid is supplied; a first branch portion that communicates with the common portion at a communication position, and that supplies the liquid from the common portion to the first liquid ejecting portion; and a second branch portion that communicates with the common portion at the communication position, and that supplies the liquid from the common portion to the second liquid ejecting portion. The temperature detection element is disposed at a vicinity of the communication position.

16 Claims, 16 Drawing Sheets

LIQUID EJECTING HEAD AND LIQUID EJECTING APPARATUS

The present application is based on, and claims priority from JP Application Serial Number 2019-038548, filed Mar. 4, 2019, the disclosure of which is hereby incorporated by reference herein in its entirety.

BACKGROUND

1. Technical Field

The present disclosure relates to a liquid ejecting head and a liquid ejecting apparatus.

2. Related Art

In the related art, a liquid ejecting apparatus that ejects a liquid such as ink from a plurality of nozzles has been proposed. For example, JP-A-2015-107652 discloses a configuration including a liquid ejecting head that ejects a liquid from a plurality of nozzles and a flow path member in which a flow path for supplying the liquid to the liquid ejecting head is formed. A filter for filtering the liquid is installed inside the flow path member. A temperature sensor for measuring a temperature of the liquid is installed in an upstream region of the filter in the flow path member.

When the liquid delivered from a liquid container is distributed to a plurality of liquid ejecting heads under the configuration of JP-A-2015-107652, the temperature sensor is individually installed for each of the plurality of liquid ejecting heads. Therefore, there is a problem that the configuration of the liquid ejecting apparatus becomes complicated due to the installation of wiring electrically coupled to each temperature sensors.

SUMMARY

According to an aspect of the present disclosure, there is provided a liquid ejecting head including: a first liquid ejecting portion that ejects a liquid; a second liquid ejecting portion that ejects a liquid; a first supply flow path that supplies the liquid to the first liquid ejecting portion and the second liquid ejecting portion; and a temperature detection element for measuring a temperature of the liquid. The first supply flow path includes a common portion to which the liquid is supplied; a first branch portion that communicates with the common portion at a communication position, and supplies the liquid from the common portion to the first liquid ejecting portion; and a second branch portion that communicates with the common portion at the communication position, and supplies the liquid from the common portion to the second liquid ejecting portion. The temperature detection element is installed in a vicinity of the communication position.

According to another aspect of the present disclosure, there is provided a liquid ejecting apparatus including: a liquid ejecting head that ejects a liquid; and an ejecting controller that controls ejecting of the liquid by the liquid ejecting head. The liquid ejecting head includes a first liquid ejecting portion that ejects a liquid; a second liquid ejecting portion that ejects a liquid; a first supply flow path that supplies the liquid to the first liquid ejecting portion and the second liquid ejecting portion; and a temperature detection element for measuring a temperature of the liquid. The first supply flow path includes a common portion to which the liquid is supplied; a first branch portion that communicates with the common portion at a communication position, and supplies the liquid from the common portion to the first liquid ejecting portion; and a second branch portion that communicates with the common portion at the communication position, and supplies the liquid from the common portion to the second liquid ejecting portion. The temperature detection element is installed in a vicinity of the communication position.

DESCRIPTION OF EXEMPLARY EMBODIMENTS

Figure 2:
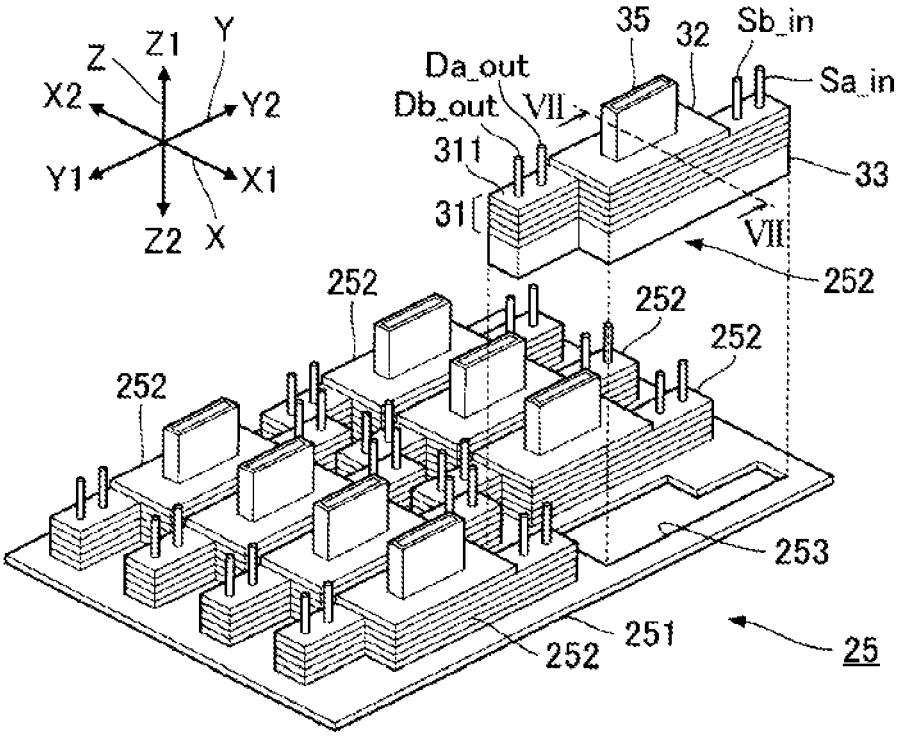
FIG. 2 is an exploded perspective view of a liquid ejecting unit.

In the following description, an X-axis, a Y-axis, and a Z-axis that are orthogonal to each other are assumed. As illustrated in FIG. 2, one direction along the X-axis when viewed from any point is denoted as an X1 direction, and a direction opposite to the X1 direction is denoted as an X2 direction. Similarly, directions opposite to each other along the Y-axis from any point are denoted as a Y1 direction and a Y2 direction, and directions opposite to each other along the Z-axis from any point are denoted as a Z1 direction and a Z2 direction. An X-Y plane including the X-axis and the Y-axis corresponds to a horizontal plane. The Z-axis is an axis along a vertical direction, and the Z2 direction corresponds to downward in the vertical direction.

Figure 1:
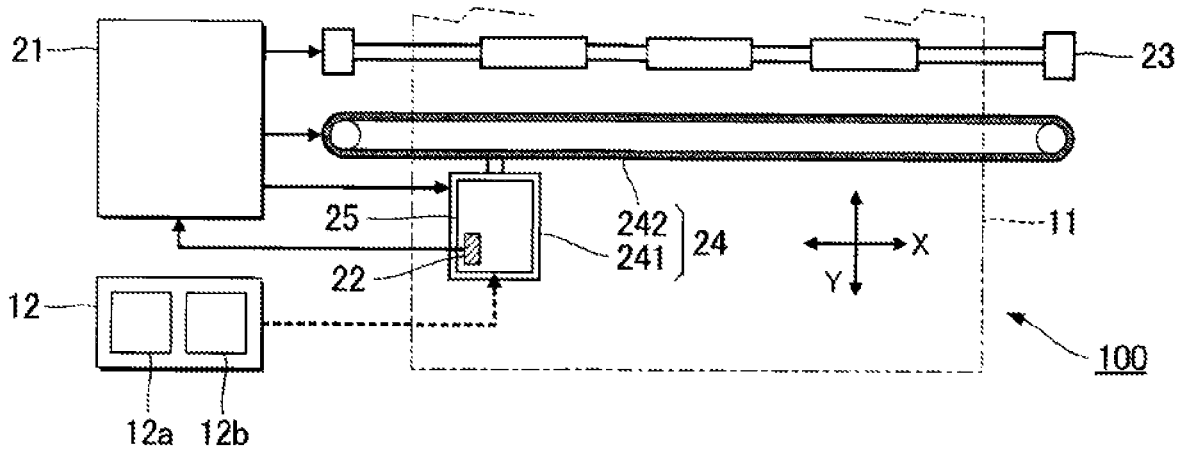
FIG. 1 is a block diagram illustrating a configuration of a liquid ejecting apparatus according to an embodiment.

FIG. 1 is a configuration diagram illustrating a liquid ejecting apparatus 100 according to a preferred embodiment.

The liquid ejecting apparatus 100 according to the present embodiment is an ink jet printing apparatus that ejects ink droplets, which are an example of a liquid, onto a medium 11. The medium 11 is typically a printing sheet. However, for example, a printing target of any material such as a resin film or a fabric is used as the medium 11.

As illustrated in FIG. 1, the liquid ejecting apparatus 100 is provided with a liquid container 12 that stores ink. For example, a cartridge, a bag-like ink pack formed of a flexible film, or an ink tank that can be refilled with ink, which can be attached and detached to and from the liquid ejecting apparatus 100, is used as the liquid container 12. As illustrated in FIG. 1, the liquid container 12 includes a first liquid container 12*a* and a second liquid container 12*b*. A first ink is stored in the first liquid container 12*a*, and a second ink is stored in the second liquid container 12*b*.

The first ink and the second ink are different types of ink. The second ink tends to be more consumed than the first ink. For example, assuming general color printing using the liquid ejecting apparatus 100, basically, consumption amounts of cyan ink and magenta ink tend to be larger than consumption amounts of color inks of other colors. Based on the tendency described above, in the present embodiment, the cyan ink or the magenta ink is used as the second ink, and color ink other than the cyan ink or the magenta ink is used as the first ink.

As illustrated in FIG. 1, the liquid ejecting apparatus 100 includes a control unit 21, a temperature detection element 22, a transport mechanism 23, a movement mechanism 24, and a liquid ejecting unit 25. The control unit 21 controls each element of the liquid ejecting apparatus 100. The control unit 21 includes, for example, a processing circuit such as a central processing unit (CPU) or a field programmable gate array (FPGA), and a storage circuit such as a semiconductor memory. The temperature detection element 22 is a temperature sensor for measuring a temperature of ink in the liquid ejecting unit 25. The temperature detection element 22 is installed in the liquid ejecting unit 25.

The transport mechanism 23 transports the medium 11 along the Y-axis under the control of the control unit 21. The movement mechanism 24 causes the liquid ejecting unit 25 to reciprocate along the X-axis under the control of the control unit 21. The movement mechanism 24 of the present embodiment includes a substantially box-shaped transport body 241 that houses the liquid ejecting unit 25, and an endless belt 242 to which the transport body 241 is fixed. A configuration in which the liquid container 12 is mounted on the transport body 241 together with the liquid ejecting unit 25 can also be employed.

The liquid ejecting unit 25 ejects the ink, which is supplied from the liquid container 12, is ejected from each of a plurality of nozzles onto the medium 11 under the control of the control unit 21. In parallel with the transport of the medium 11 by the transport mechanism 23 and the repetitive reciprocation of the transport body 241, the liquid ejecting unit 25 ejects the ink onto the medium 11, whereby an image is formed on a surface of the medium 11.

FIG. 2 is an exploded perspective view of the liquid ejecting unit 25. As illustrated in FIG. 2, the liquid ejecting unit 25 of the present embodiment includes a support body 251 and a plurality of liquid ejecting heads 252. The support body 251 is a plate-like member that supports the plurality of liquid ejecting heads 252. A plurality of attachment holes 253 are formed in the support body 251. Each liquid ejecting head 252 is supported by the support body 251 in a state of being inserted into the attachment hole 253. The plurality of liquid ejecting heads 252 are arranged in a matrix shape along the X-axis and the Y-axis. However, the number of the liquid ejecting heads 252 and the arrangement form of the plurality of liquid ejecting heads 252 are not limited to the example described above.

Each of the plurality of liquid ejecting heads 252 ejects ink droplets under the control of the control unit 21. That is, the control unit 21 functions as an ejecting controller that controls ejecting of the ink by the liquid ejecting head 252.

As illustrated in FIG. 2, the liquid ejecting head 252 includes a flow path structure 31, a wiring substrate 32, and a holding member 33. The flow path structure 31 is located between the wiring substrate 32 and the holding member 33. Specifically, the holding member 33 is installed in the Z2 direction with respect to the flow path structure 31, and the wiring substrate 32 is installed in the Z1 direction with respect to the flow path structure 31.

Figure 3:
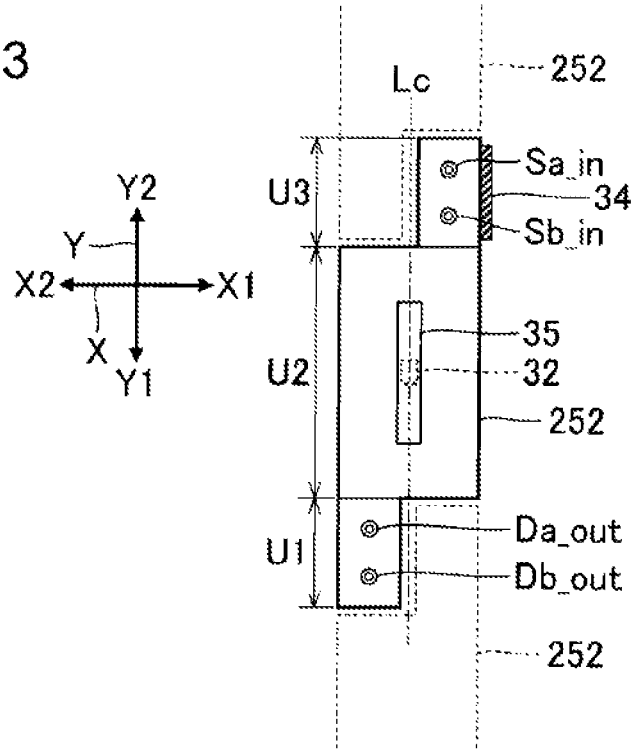
FIG. 3 is a plan view of a liquid ejecting head.

FIG. 3 is a plan view of the liquid ejecting head 252 viewed in the Z1 direction. As illustrated in FIG. 3, the flow path structure 31 and the holding member 33 of each liquid ejecting head 252 are configured of an outer shape including a first portion U1, a second portion U2, and a third portion U3 in a plan view along the Z-axis. The first portion U1, the second portion U2, and the third portion U3 are arranged along the Y-axis. The second portion U2 is located between the first portion U1 and the third portion U3. Specifically, the first portion U1 is located in the Y1 direction with respect to the second portion U2, and the third portion U3 is located in the Y2 direction with respect to the second portion U2. The wiring substrate 32 is formed in an outer shape corresponding to the second portion U2.

FIG. 3 illustrates a center line Lc of the second portion U2 along the Y-axis. The first portion U1 is located in the X2 direction with respect to the center line Lc, and the third portion U3 is located in the X1 direction with respect to the center line Lc. That is, the first portion U1 and the third portion U3 are located in opposite directions across the center line Lc. As illustrated in FIG. 3, the plurality of liquid ejecting heads 252 are arranged along the Y-axis, so that the third portion U3 of each liquid ejecting head 252 and the first portion U1 of another liquid ejecting head 252 are adjacent to each other in the X-axis direction.

As illustrated in FIG. 3, each liquid ejecting head 252 includes a ground portion 34. The ground portion 34 is an electrode used for the ground of the liquid ejecting head 252. The ground portion 34 is installed along a side surface of the third portion U3 in the X1 direction. That is, in the third portion U3, the ground portion 34 is installed on a surface opposite to a surface facing the first portion U1 of another liquid ejecting head 252 adjacent in the Y2 direction. In the above configuration, the ground portion 34 is not interposed between the third portion U3 of each liquid ejecting head 252 and the first portion U1 of another liquid ejecting head 252 adjacent in the Y2 direction. Accordingly, it is possible to install the plurality of liquid ejecting heads 252 in a state in which the first portion U1 and the third portion U3 are sufficiently brought close to each other, compared with a configuration in which the ground portion 34 is interposed between the first portion U1 and the third portion U3 in the liquid ejecting heads 252 adjacent in the Y2 direction.

Figure 4:
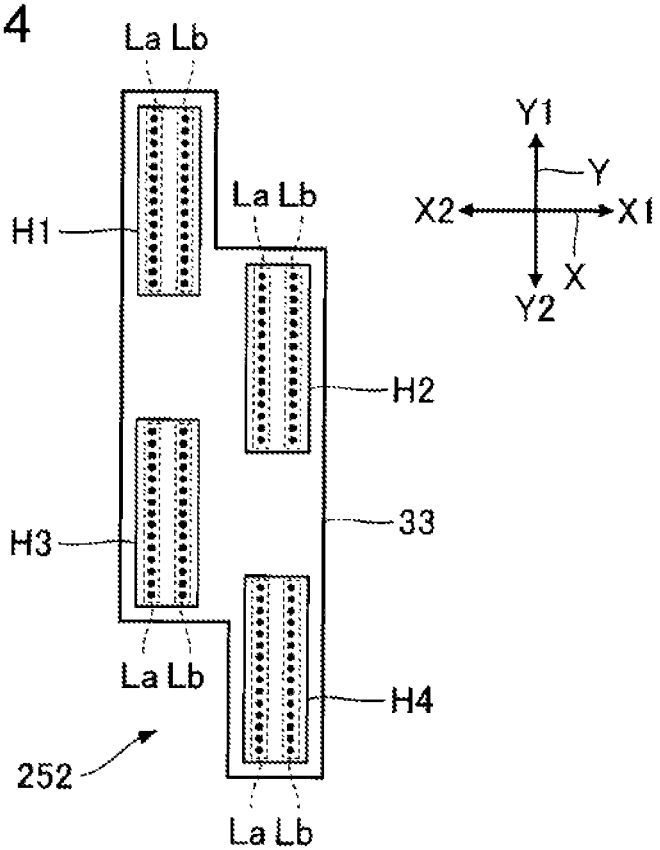
FIG. 4 is a plan view of the liquid ejecting head.

FIG. 4 is a plan view of the liquid ejecting head 252 viewed in the Z2 direction. As illustrated in FIG. 4, the liquid ejecting head 252 includes four circulation heads H1 to H4. The holding member 33 in FIG. 2 is a structure that houses and supports the four circulation heads H1 to H4. Each circulation head Hn (n=1 to 4) ejects the ink from a plurality of nozzles N. As illustrated in FIG. 4, the plurality of nozzles N are divided into a first nozzle row La and a second nozzle row Lb. Each of the first nozzle row La and the second nozzle row Lb is a set of the plurality of nozzles N arranged along the Y-axis. The first nozzle row La and the second nozzle row Lb are provided side by side with an interval in the X-axis direction. In the following description, the subscript a is added to a symbol of an element related to the first nozzle row La, and the subscript b is added to a symbol of an element related to the second nozzle row Lb.

Figure 5:
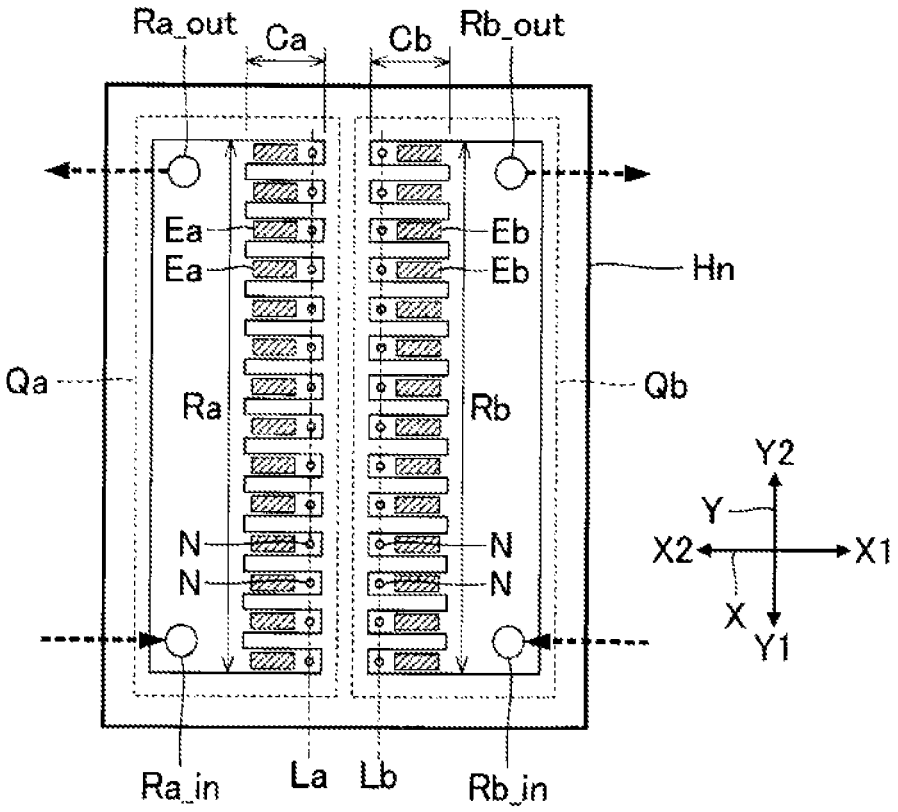
FIG. 5 is a plan view illustrating a configuration of a circulation head.

FIG. 5 is a plan view illustrating a configuration of each circulation head Hn. FIG. 5 schematically illustrates an internal structure of the circulation head Hn as viewed in the Z1 direction. As illustrated in FIG. 5, each circulation head Hn includes a first liquid ejecting portion Qa and a second liquid ejecting portion Qb. The first liquid ejecting portion Qa of each circulation head Hn ejects the first ink supplied from the first liquid container 12*a*, from each nozzle N of the first nozzle row La. The second liquid ejecting portion Qb of each circulation head Hn ejects the second ink supplied from the second liquid container 12*b*, from each nozzle N of the second nozzle row Lb.

The first liquid ejecting portion Qa includes a first liquid storage chamber Ra, a plurality of pressure chambers Ca, and a plurality of drive elements Ea. The first liquid storage chamber Ra is a common liquid chamber that is continuous over the plurality of nozzles N of the first nozzle row La. The pressure chamber Ca and the drive element Ea are formed for each nozzle N in the first nozzle row La. The pressure chamber Ca is a space communicating with the nozzle N. Each of the plurality of pressure chambers Ca is filled with the first ink supplied from the first liquid storage chamber Ra. The drive element Ea varies a pressure of the first ink in the pressure chamber Ca. For example, a piezoelectric element that changes a volume of the pressure chamber Ca by deforming a wall surface of the pressure chamber Ca or a heating element that generates bubbles in the pressure chamber Ca by heating the first ink in the pressure chamber Ca is suitably used as the drive element Ea. The drive element Ea varies the pressure of the first ink in the pressure chamber Ca, so that the first ink in the pressure chamber Ca is ejected from the nozzle N. That is, the pressure chamber Ca functions as an energy generation chamber that generates energy for ejecting the first ink supplied from the first liquid storage chamber Ra.

Similar to the first liquid ejecting portion Qa, the second liquid ejecting portion Qb includes a second liquid storage chamber Rb, a plurality of pressure chambers Cb, and a plurality of drive elements Eb. The second liquid storage chamber Rb is a common liquid chamber that is continuous over the plurality of nozzles N of the second nozzle row Lb. The pressure chamber Cb and the drive element Eb are formed for each nozzle N in the second nozzle row Lb. Each of the plurality of pressure chambers Cb is filled with the second ink supplied from the second liquid storage chamber Rb. The drive element Eb is, for example, the piezoelectric element or the heating element described above. The drive element Eb varies the pressure of the second ink in the pressure chamber Cb, so that the second ink in the pressure chamber Cb is ejected from the nozzle N. That is, similar to the pressure chamber Ca, the pressure chamber Cb functions as an energy generation chamber that generates energy for ejecting the second ink supplied from the second liquid storage chamber Rb.

As illustrated in FIG. 5, each circulation head Hn is provided with a supply port Ra_in, a discharging port Ra_out, a supply port Rb_in, and a discharging port Rb_out. The supply port Ra_in and the discharging port Ra_out communicate with the first liquid storage chamber Ra. The supply port Rb_in and the discharging port Rb_out communicate with the second liquid storage chamber Rb.

The flow path structure 31 in FIG. 2 is a structure in which a flow path for supplying the ink stored in the liquid container 12 to the four circulation heads H1 to H4 is formed inside. The wiring substrate 32 is a mounting component for electrically coupling each liquid ejecting head 252 to the control unit 21.

Figure 6:
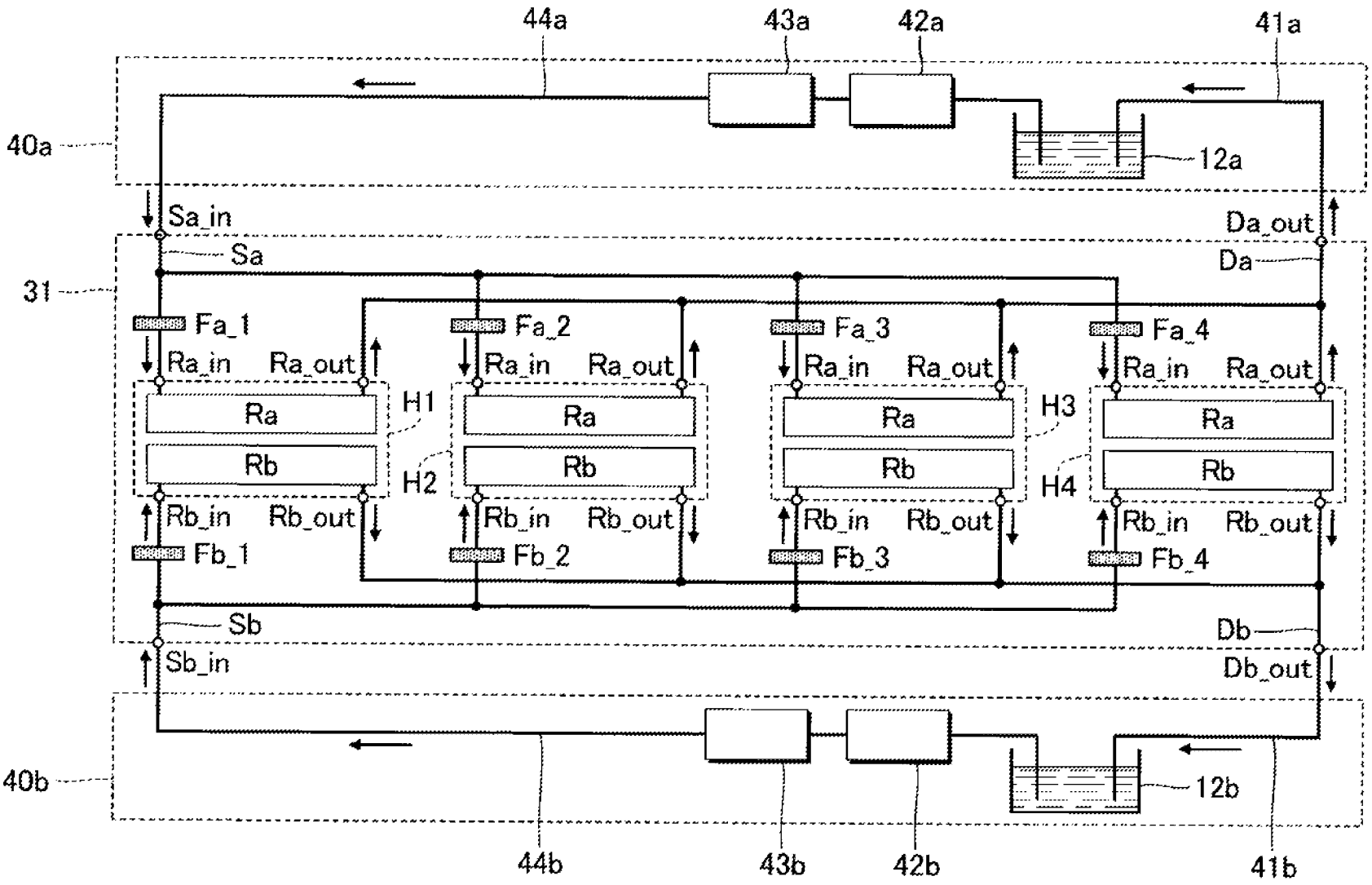
FIG. 6 is an explanatory diagram of ink flow paths in the liquid ejecting head.

FIG. 6 is an explanatory diagram of ink flow paths in the liquid ejecting head 252. In FIG. 6, the four circulation heads H1 to H4 are illustrated inside broken frames representing the flow path structure 31 for the sake of convenience, but are actually located outside the flow path structure 31.

As illustrated in FIG. 6, the flow path structure 31 includes a first supply port Sa_in, a first discharging port Da_out, a second supply port Sb_in, and a second discharging port Db_out. The first ink stored in the first liquid container 12*a* is supplied to the first supply port Sa_in. The second ink stored in the second liquid container 12*b* is supplied to the second supply port Sb_in. As illustrated in FIG. 6, a first supply flow path Sa, a first discharging flow path Da, a second supply flow path Sb, and a second discharging flow path Db are formed in the flow path structure 31.

The first supply flow path Sa is a flow path for supplying the first ink supplied from the first liquid container 12*a* to the first supply port Sa_in, to the four circulation heads H1 to H4. In the first supply flow path Sa, a filter portion Fa_n is formed for each circulation head Hn in an upstream region of the supply port Ra_in of each circulation head Hn. Each filter portion Fa_n is provided with a filter that collects foreign matters or bubbles mixed in the first ink. The first ink that has passed through the first supply port Sa_in, the first supply flow path Sa, and the filter portion Fa_n is supplied to the first liquid storage chamber Ra via the supply port Ra_in of each circulation head Hn.

In the first ink supplied to the first liquid storage chamber Ra, the first ink that is not ejected from each nozzle N of the first nozzle row La is discharged from the discharging port Ra_out. The first discharging flow path Da is a flow path for discharging the first ink from the four circulation heads H1 to H4 to the first discharging port Da_out. Specifically, the first ink discharged from the first liquid storage chamber Ra of each circulation head Hn to the discharging port Ra_out passes through the first discharging flow path Da and is discharged from the first discharging port Da_out to outside the flow path structure 31.

The second supply flow path Sb is a flow path for supplying the second ink supplied from the second liquid container 12*b* to the second supply port Sb_in, to the four circulation heads H1 to H4. In the second supply flow path Sb, a filter portion Fb_n is formed for each circulation head Hn in the upstream region of the supply port Rb_in of each circulation head Hn. Each filter portion Fb_n is provided with a filter that collects foreign matters or bubbles mixed in the second ink. The second ink that has passed through the second supply port Sb_in, the second supply flow path Sb, and the filter portion Fb_n is supplied to the second liquid storage chamber Rb via the supply port Rb_in of each circulation head Hn.

In the second ink supplied to the second liquid storage chamber Rb, the second ink that is not ejected from each nozzle N of the second nozzle row Lb is discharged from the discharging port Rb_out. The second discharging flow path Db is a flow path for discharging the second ink from the four circulation heads H1 to H4 to the second discharging port Db_out. Specifically, the second ink discharged from the second liquid storage chamber Rb of each circulation head Hn to the discharging port Rb_out passes through the second discharging flow path Db and is discharged from the second discharging port Db_out to outside the flow path structure 31.

As illustrated in FIG. 6, the liquid ejecting apparatus 100 includes a first circulation mechanism 40*a* and a second circulation mechanism 40*b*. The first circulation mechanism 40*a* includes a first circulation flow path 41*a*, a first circulation pump 42*a*, a first heating mechanism 43*a*, and a first supply flow path 44*a*. The first circulation flow path 41*a* circulates the first ink discharged from the first discharging port Da_out of the flow path structure 31, to the first liquid container 12*a*. The first circulation pump 42*a* is a pressure feeding mechanism that delivers the first ink stored in the first liquid container 12*a* at a predetermined pressure.

The first heating mechanism 43*a* adjusts the temperature of the first ink by heating the first ink delivered from the first circulation pump 42*a*. For example, a heating element such as a heating wire is used as the first heating mechanism 43*a*. The first supply flow path 44*a* supplies the first ink heated by the first heating mechanism 43*a*, to the first supply port Sa_in of the flow path structure 31. That is, the first heating mechanism 43*a* is installed in the upstream region of the first supply flow path Sa and heats the first ink supplied to the first supply flow path Sa.

As understood from the above description, in the first ink stored in the first liquid storage chamber Ra of each circulation head Hn, the first ink, which is not ejected from each nozzle N of the first nozzle row La, circulates through a flow path of the discharging port Ra_out→the first discharging flow path Da→the first discharging port Da_out→the first circulation flow path 41*a*→the first liquid container 12*a*→the first circulation pump 42*a*→the first heating mechanism 43*a*→the first supply flow path 44*a*→the first supply port Sa_in→the first supply flow path Sa→the filter portion Fa_n→the supply port Ra_in→the first liquid storage chamber Ra. That is, a circulation operation is performed in which the first ink, which is not ejected in each circulation head Hn, is circulated to the circulation head Hn.

Similar to the first circulation mechanism 40*a*, the second circulation mechanism 40*b* includes a second circulation flow path 41*b*, a second circulation pump 42*b*, a second heating mechanism 43*b*, and a second supply flow path 44*b*. The second circulation flow path 41*b* circulates the second ink discharged from the second discharging port Db_out of the flow path structure 31, to the second liquid container 12*b*. The second circulation pump 42*b* delivers the second ink stored in the second liquid container 12*b* at a predetermined pressure. The second heating mechanism 43*b* is installed in the upstream region of the second supply flow path Sb and heats the second ink supplied to the second supply flow path Sb.

As understood from the above description, in the second ink stored in the second liquid storage chamber Rb of each circulation head Hn, the second ink, which is not ejected from each nozzle N of the second nozzle row Lb, circulates through a flow path of the discharging port Rb_out→the second discharging flow path Db→the second discharging port Db_out→the second circulation flow path 41*b*→the second liquid container 12*b*→the second circulation pump 42*b*→the second heating mechanism 43*b*→the second supply flow path 44*b*→the second supply port Sb_in→the second supply flow path Sb→the filter portion Fb_n→the supply port Rb_in→the second liquid storage chamber Rb. That is, a circulation operation is performed in which the second ink, which is not ejected in each circulation head Hn, is circulated to the circulation head Hn. The circulation operation of the first ink and the second ink is executed, for example, in parallel with the ejecting operation by each liquid ejecting head 252.

The control unit 21 controls the first heating mechanism 43*a* and the second heating mechanism 43*b* in accordance with the temperature (hereinafter referred to as "measured temperature") measured by the temperature detection element 22. For example, the control unit 21 operates the first heating mechanism 43*a* and the second heating mechanism 43*b* when the measured temperature falls below a predetermined threshold, and stops heating by the first heating mechanism 43*a* and the second heating mechanism 43*b* when the measured temperature exceeds the threshold. As understood from the above description, the control unit 21 functions as a temperature controller that controls the first heating mechanism 43*a* and the second heating mechanism 43*b*.

The temperature of the first ink heated by the first heating mechanism 43*a* of the first circulation mechanism 40*a* gradually decreases in a process in which the first ink passes through the first supply flow path Sa, the first liquid storage chamber Ra, and the first discharging flow path Da. Therefore, there is a temperature difference between the first ink in the first supply flow path Sa and the first ink in the first discharging flow path Da. Similarly, the temperature of the second ink heated by the second heating mechanism 43*b* of the second circulation mechanism 40*b* gradually decreases in a process in which the second ink passes through the second supply flow path Sb, the second liquid storage chamber Rb, and the second discharging flow path Db. Therefore, there is a temperature difference between the second ink in the second supply flow path Sb and the second ink in the second discharging flow path Db.

Figure 7:
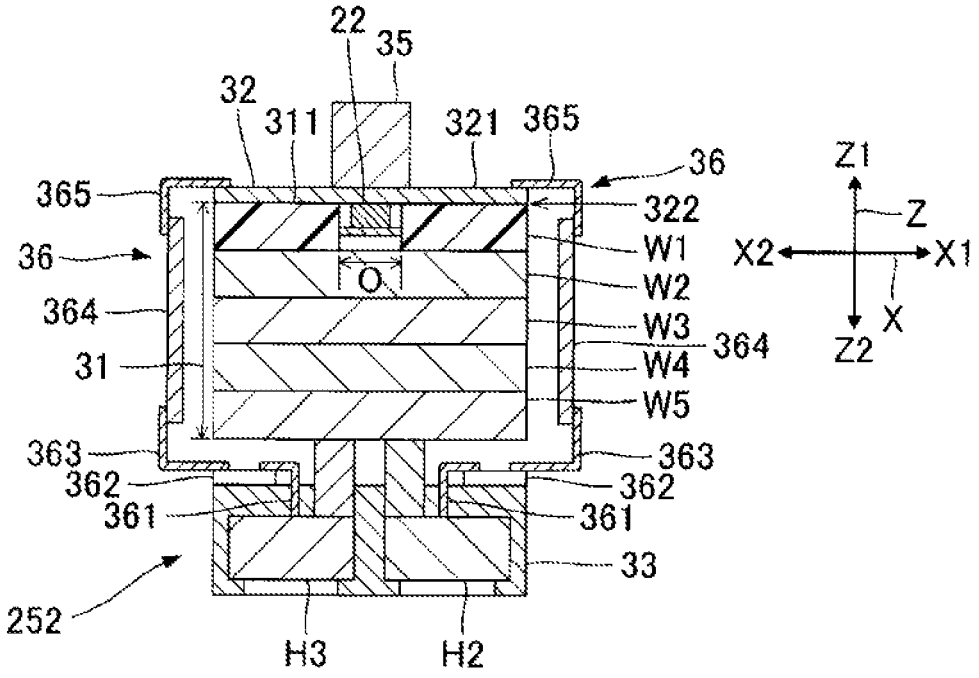
FIG. 7 is a sectional view of the liquid ejecting head.

FIG. 7 is a sectional view taken along line VII-VII in FIG. 2. As illustrated in FIG. 7, the liquid ejecting head 252 includes coupling portions 36 for electrically coupling the circulation head Hn to the wiring substrate 32 for each of the four circulation heads H1 to H4. The coupling portion 36 includes a first wiring portion 361, a second wiring portion 362, a third wiring portion 363, a fourth wiring portion 364, and a fifth wiring portion 365. In addition, in FIG. 2, illustration of each coupling portion 36 is omitted for convenience.

The second wiring portion 362 and the fourth wiring portion 364 are rigid wiring substrates in which wiring is formed on a surface of a hard plate-like member. The first wiring portion 361, the third wiring portion 363, and the fifth wiring portion 365 are flexible wiring substrates in which wiring is formed on a surface of a flexible film. The second wiring portion 362 is installed between the flow path structure 31 and the circulation head Hn, and the fourth wiring portion 364 faces a side surface of the flow path structure 31. The first wiring portion 361 electrically couples the circulation head Hn and the second wiring portion 362. The third wiring portion 363 electrically couples the second wiring portion 362 and the fourth wiring portion 364. The fifth wiring portion 365 electrically couples the fourth wiring portion 364 and the wiring substrate 32.

As illustrated in FIG. 7, the flow path structure 31 is configured by stacking a plurality of substrates W (W1 to W5). The plurality of substrates W constituting the flow path structure 31 are formed by, for example, injection molding of a resin material. The plurality of substrates W are bonded to each other by, for example, an adhesive.

Specifically, the flow path structure 31 is a structure configured by stacking the first substrate W1, the second substrate W2, the third substrate W3, the fourth substrate W4, and the fifth substrate W5 in this order in the Z2 direction. The first substrate W1 is located on an outermost layer in the Z1 direction, and the fifth substrate W5 is located on an outermost layer in the Z2 direction. It may be expressed that the first substrate W1 is located in the uppermost layer in the vertical direction and the fifth substrate W5 is located in the lowermost layer in the vertical direction. The fifth substrate W5 faces the holding member 33 and the four circulation heads H1 to H4. As illustrated in FIG. 2, the first supply port Sa_in, the first discharging port Da_out, the second supply port Sb_in, and the second discharging port Db_out protrudes from the surface 311 (hereinafter referred to as "top-layer surface") of the first substrate W1 in the Z1 direction.

As illustrated in FIG. 7, the wiring substrate 32 is a plate-like member including a first surface 321 and a second surface 322. The first surface 321 is a surface of the wiring substrate 32 in the Z1 direction. The second surface 322 is a surface of the wiring substrate 32 in the Z2 direction. That is, the second surface 322 is located opposite to the first surface 321. A connector 35 is installed on the first surface 321 of the wiring substrate 32. The connector 35 is a coupling component for electrically coupling the liquid ejecting head 252 and the control unit 21. That is, various signals for driving the liquid ejecting head 252 are supplied from the control unit 21 to the connector 35. As illustrated in FIG. 7, the wiring substrate 32 is installed so that the second surface 322 faces the first substrate W1 of the flow path structure 31.

As illustrated in FIGS. 2 and 7, the temperature detection element 22 described above is installed on the second surface 322 of the wiring substrate 32. Specifically, the temperature detection element 22 is installed in a region other than a region where wiring to which a drive signal or a power supply voltage is supplied is formed, on the second surface 322.

Figure 8:
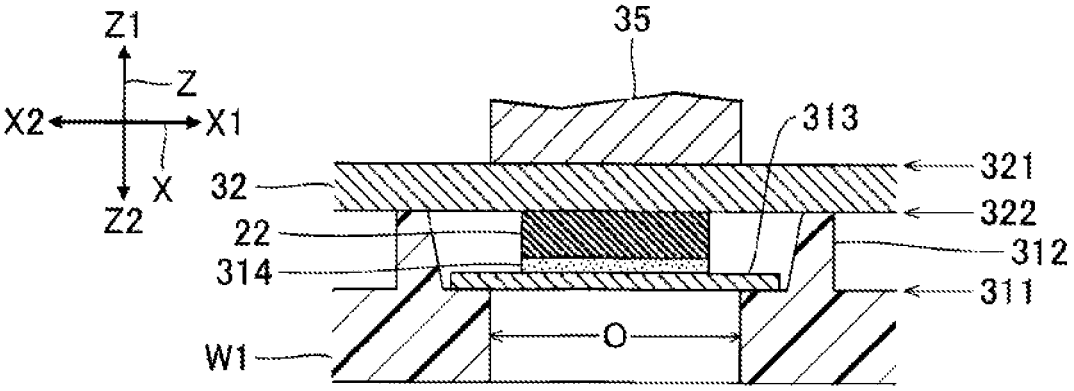
FIG. 8 is an enlarged sectional view in a vicinity of a temperature detection element in the liquid ejecting head.

FIG. 8 is an enlarged sectional view in a vicinity of the temperature detection element 22 in FIG. 7. As illustrated in FIG. 8, a detection hole O is formed in the first substrate W1 of the flow path structure 31. The detection hole O is an opening that penetrates the first substrate W1. A wall member 313 is installed on a top-layer surface 311 of the first substrate W1. The wall member 313 is a plate-like member that closes the detection hole O, and is bonded to the top-layer surface 311, for example, with an adhesive. The wall member 313 is formed of a material having a higher thermal conductivity than that of the first substrate W1. For example, the first substrate W1 is made of a resin material, and the wall member 313 is made of a metal thin film.

As illustrated in FIG. 8, a support portion 312 is formed on the top-layer surface 311 of the first substrate W1. The support portion 312 is a portion that protrudes from the top-layer surface 311 in the Z1 direction and is formed in an annular shape surrounding the wall member 313. The wiring substrate 32 is installed such that a top surface of the support portion 312 is in contact with the second surface 322. That is, the support portion 312 supports the wiring substrate 32. In the configuration described above, the temperature detection element 22 is installed in a space surrounded by a surface of the wall member 313, an inner peripheral surface of the support portion 312, and the second surface 322 of the wiring substrate 32. As understood from FIG. 8, the temperature detection element 22 is located inside an inner peripheral edge of the detection hole O when viewed in the Z1 direction. As illustrated in FIG. 8, a gap between the temperature detection element 22 and the surface of the wall member 313 may be filled with, for example, a heat conductive filler 314 such as heat conductive grease.

As described above, the temperature detection element 22 is installed inside the detection hole O formed in the first substrate W1. That is, the temperature detection element 22 is installed on the first substrate W1 located in an outermost layer among the plurality of substrates W constituting the flow path structure 31. According to the configuration described above, for example, there is an advantage that a configuration for installing the temperature detection element 22 in the flow path structure 31 is simplified as compared with a configuration for installing the temperature detection element 22 inside the flow path structure 31.

As will be described later, the detection hole O communicates with the flow path inside the flow path structure 31. Therefore, the temperature detection element 22 measures the temperature of the ink inside the flow path structure 31. In the present embodiment, since the temperature detection element 22 is installed on the second surface 322 of the wiring substrate 32, it is possible to install the temperature detection element 22 at an appropriate position by a simple process of installing the wiring substrate 32, so that the second surface 322 faces the first substrate W1.

Figure 9:
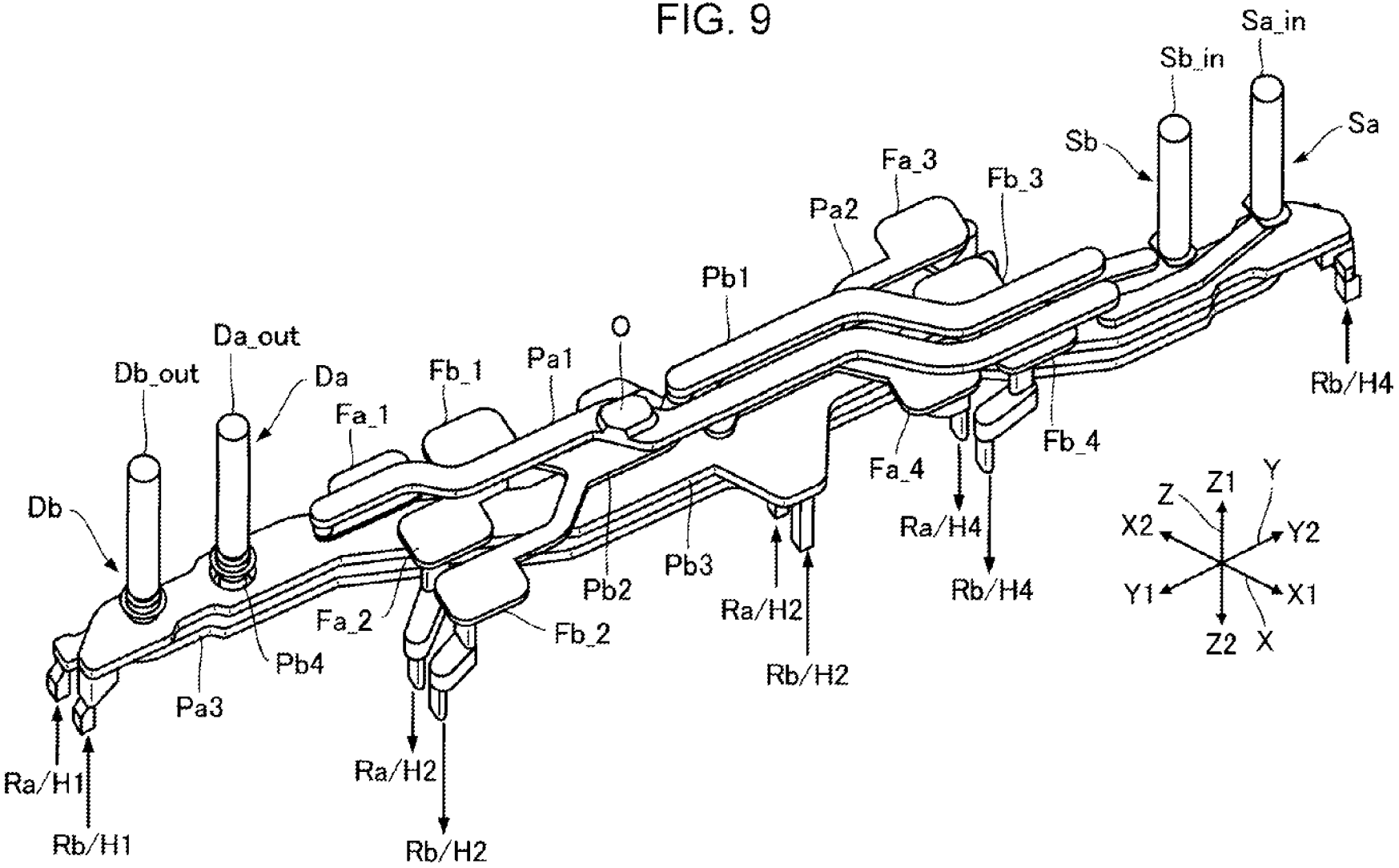
FIG. 9 is a perspective view of a flow path formed inside a flow path structure.
Figure 10:
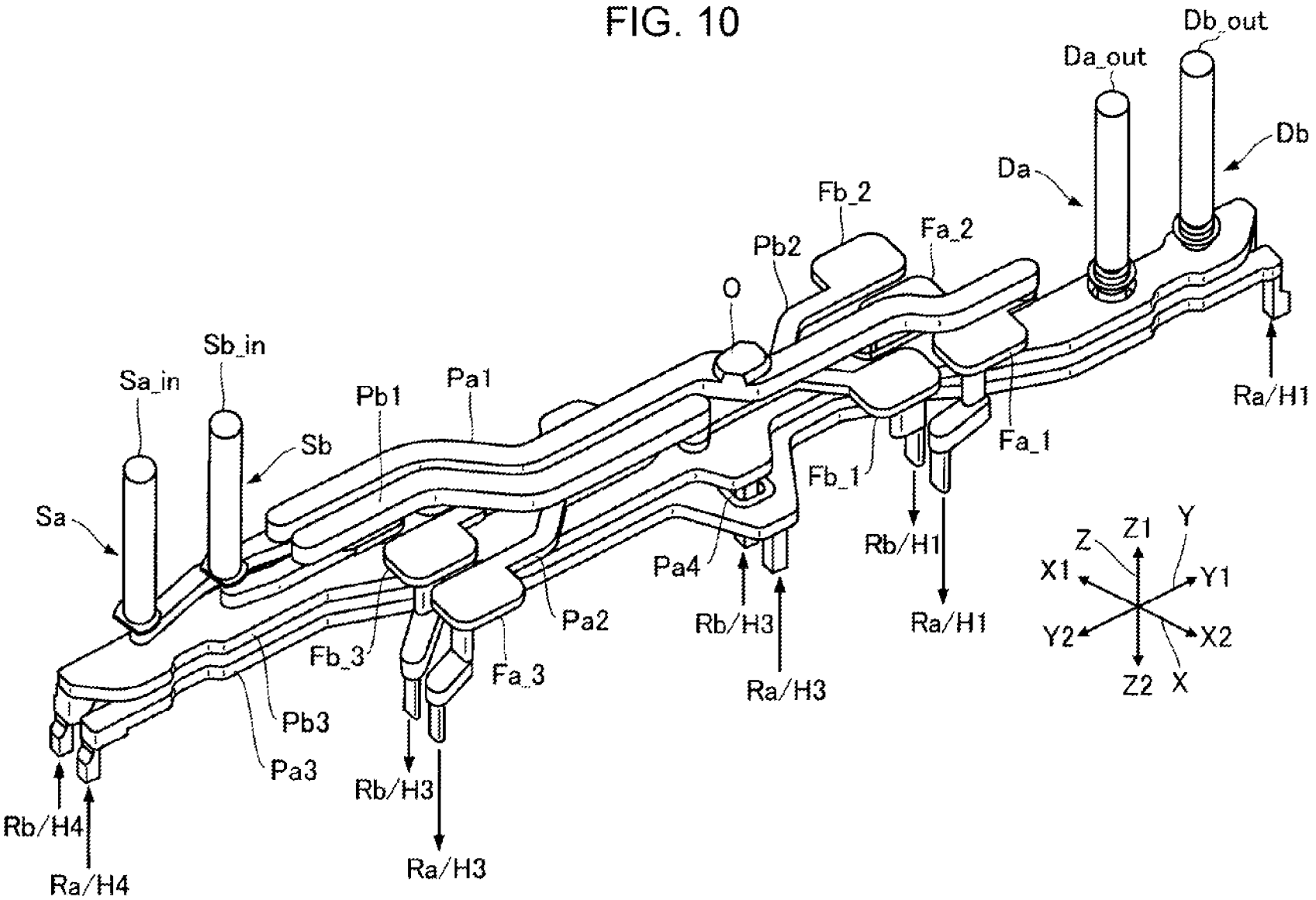
FIG. 10 is a perspective view of the flow path formed inside the flow path structure.
Figure 11:
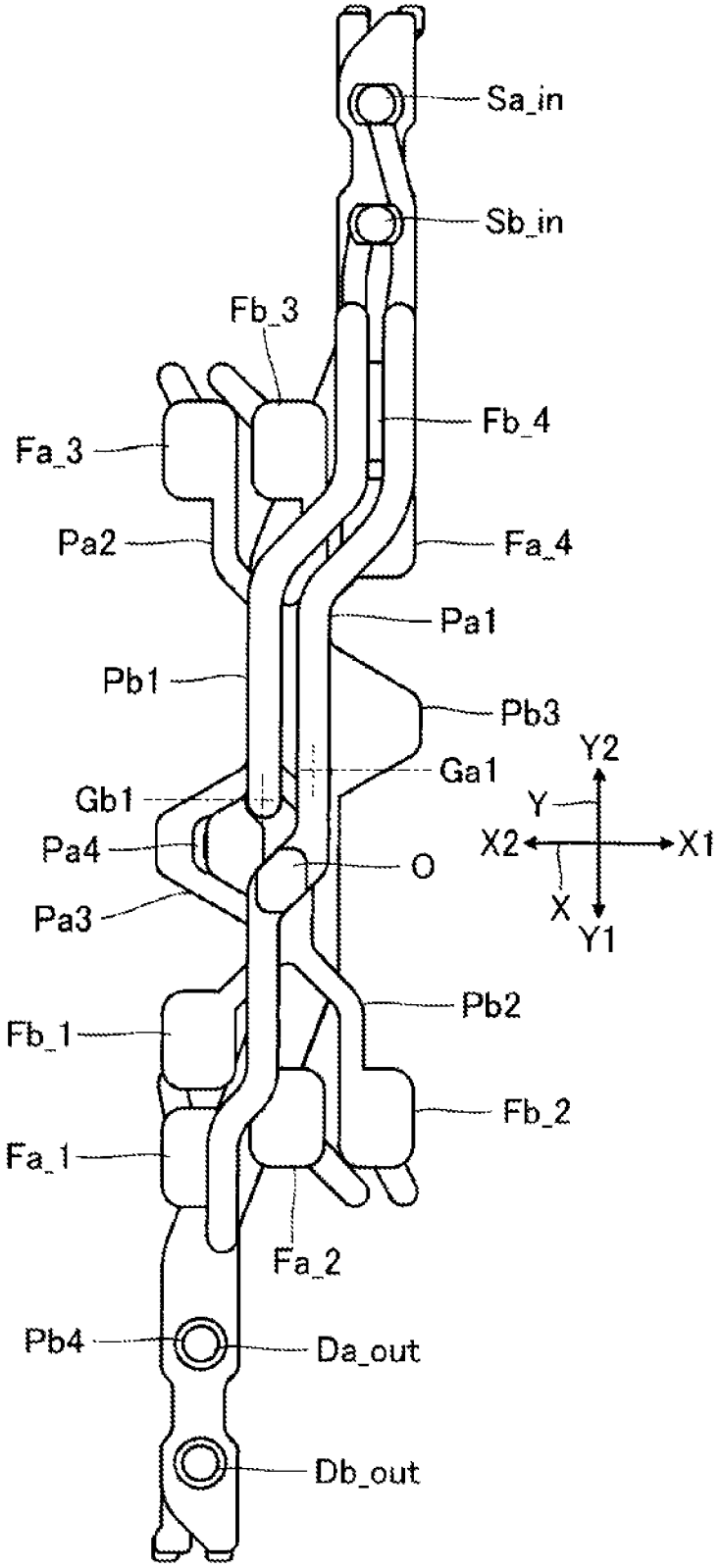
FIG. 11 is a plan view of the flow path formed inside the flow path structure.
Figure 12:
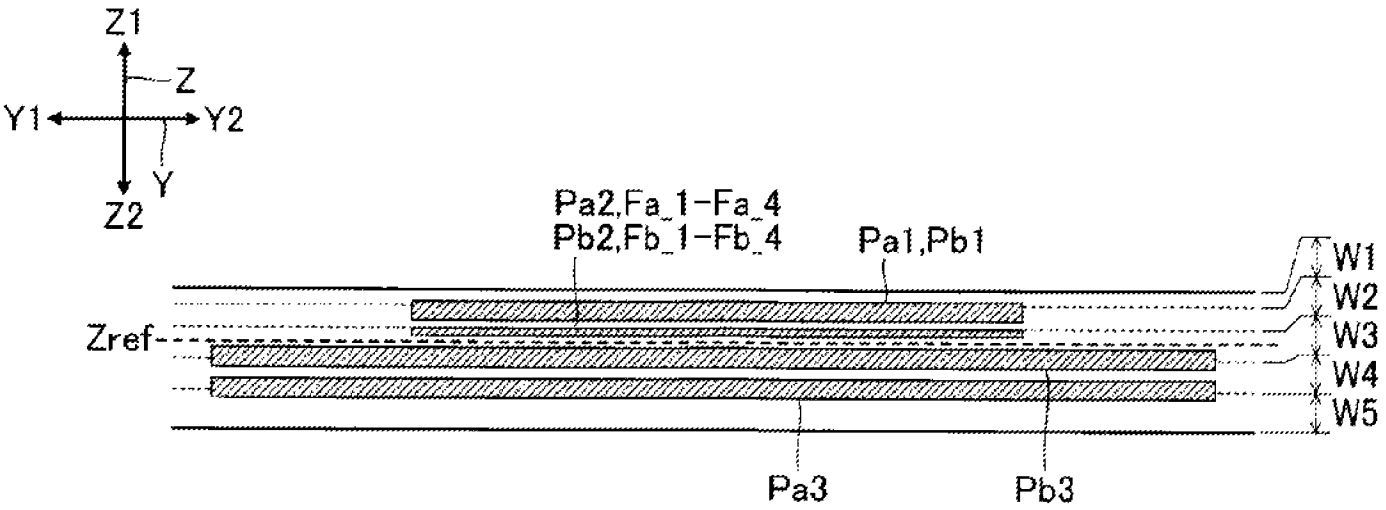
FIG. 12 is an explanatory view of a relationship between a plurality of substrates and an internal flow path constituting the flow path structure.

FIGS. 9 and 10 are perspective views of the flow path formed inside the flow path structure 31. FIG. 11 is a plan view of the flow path of the flow path structure 31 as viewed in the Z1 direction. FIG. 12 is a schematic view for explaining a relationship between the plurality of substrates W constituting the flow path structure 31 and the flow paths.

The first supply flow path Sa, the first discharging flow path Da, the second supply flow path Sb, and the second discharging flow path Db are formed by a space formed between the substrates W adjacent to each other along the Z-axis, among the plurality of substrates W constituting the flow path structure 31. Specifically, when attention is paid to any substrate Wm and a substrate Wm+1 adjacent to each other along the Z-axis among the plurality of substrates W (m=1 to 4), a flow path between the substrate Wm and the substrate Wm+1 is formed by one or both of a groove portion formed on a surface of the substrate Wm facing the substrate Wm+1, and a groove portion formed on a surface of the substrate Wm+1 facing the substrate Wm.

As described above, the first supply flow path Sa is a flow path from the first supply port Sa_in to the first liquid storage chamber Ra of each circulation head Hn, and the first discharging flow path Da is a flow path from the first liquid storage chamber Ra of each circulation head Hn to the first discharging port Da_out. The second supply flow path Sb is a flow path from the second supply port Sb_in to the second liquid storage chamber Rb of each circulation head Hn, and the second discharging flow path Db is a flow path from the second liquid storage chamber Rb of each circulation head Hn to the first discharging port Da_out.

Figure 13:
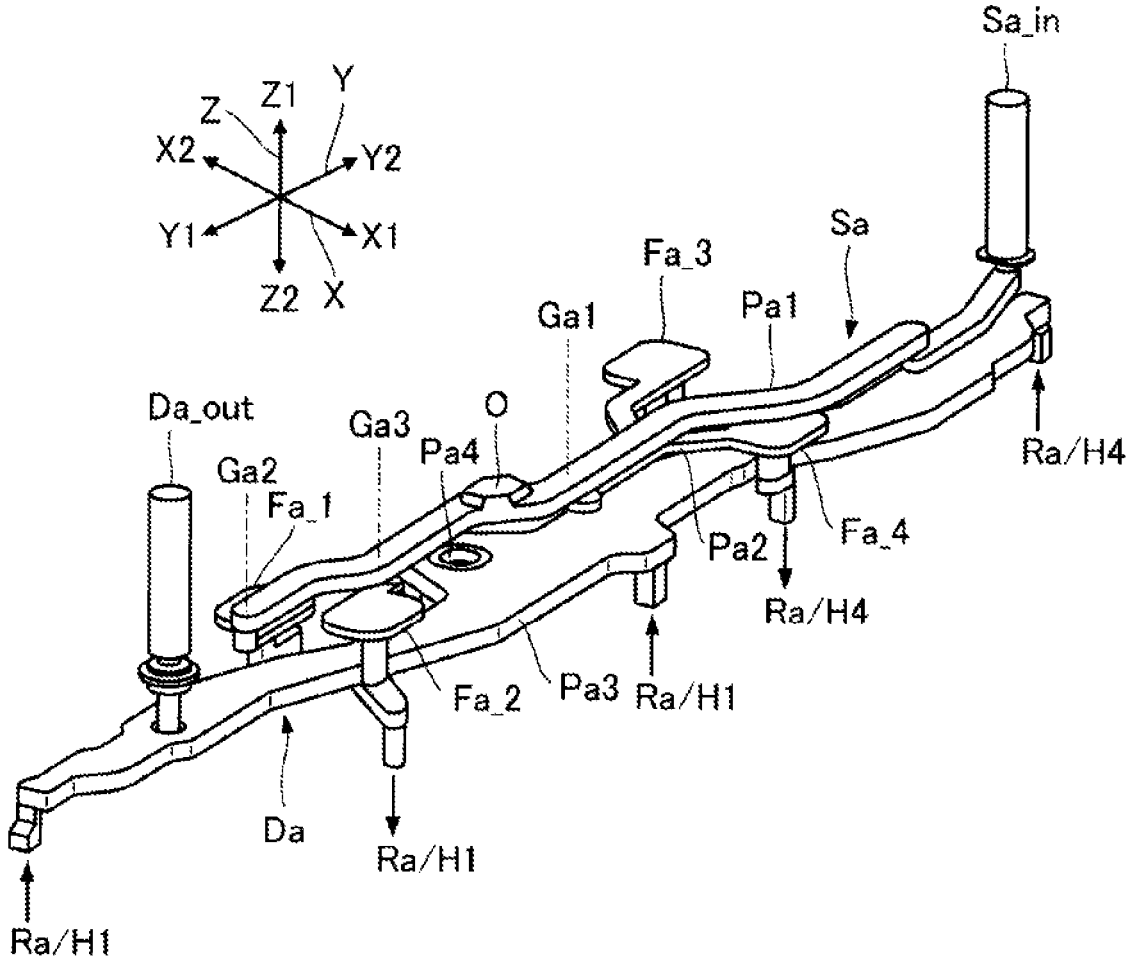
FIG. 13 is a perspective view of a first supply flow path and a first discharging flow path.
Figure 14:
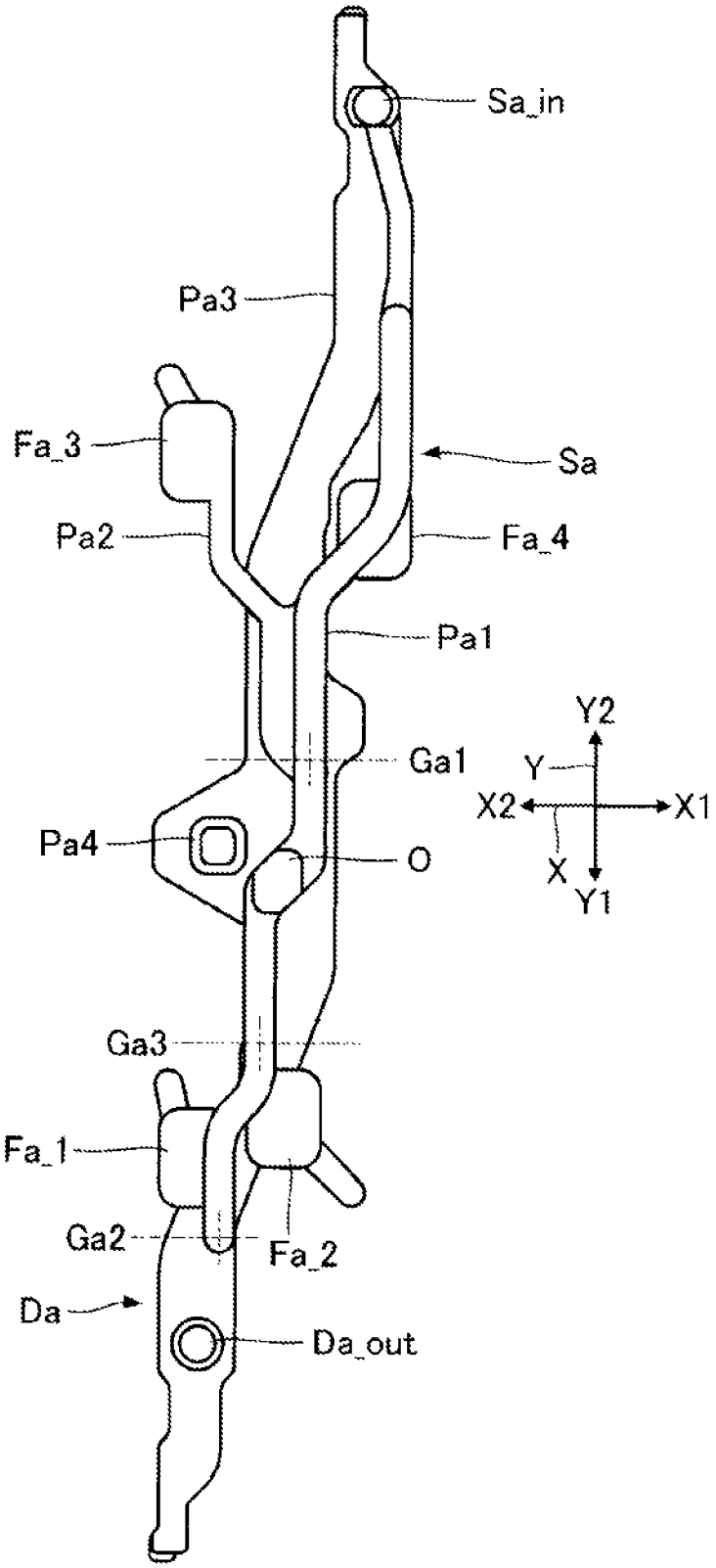
FIG. 14 is a plan view of the first supply flow path and the first discharging flow path.
Figure 15:
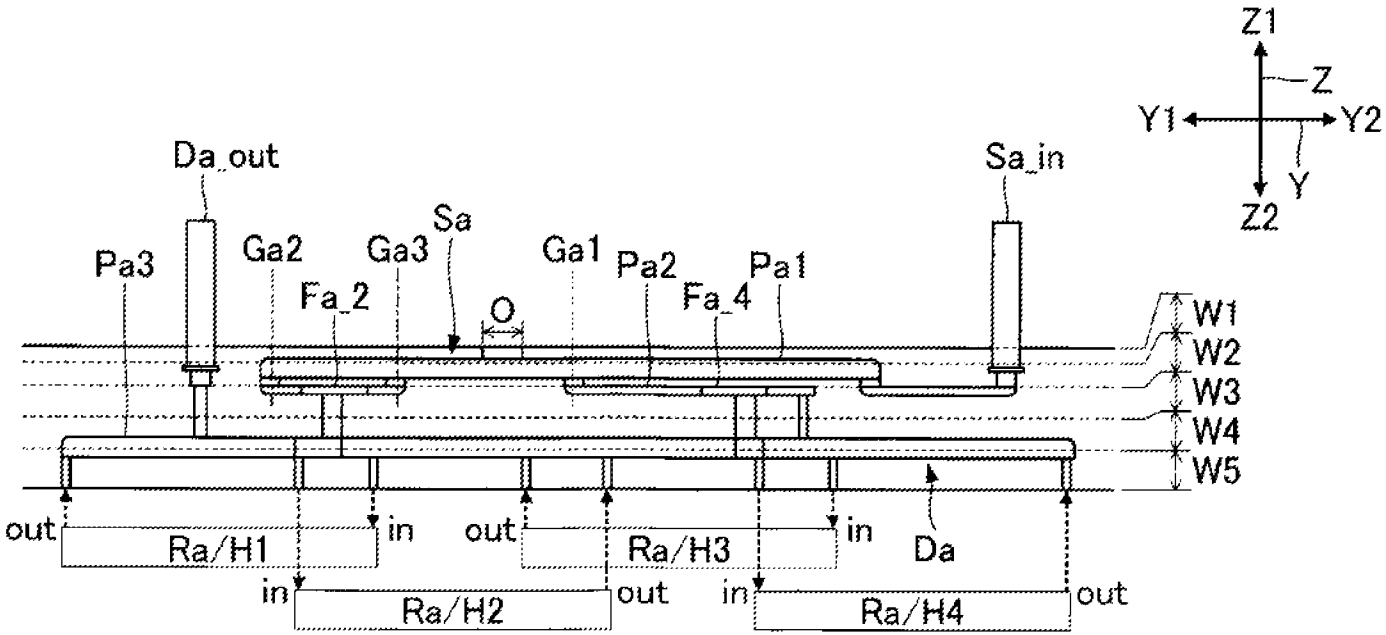
FIG. 15 is a side view of the first supply flow path and the first discharging flow path.

FIG. 13 is a perspective view in which the first supply flow path Sa and the first discharging flow path Da are extracted. FIG. 14 is a plan view of the first supply flow path Sa and the first discharging flow path Da, and FIG. 15 is a side view of the first supply flow path Sa and the first discharging flow path Da. In each drawing referred to in the following description, the first liquid storage chamber Ra of each circulation head Hn is represented by a symbol "Ra/Hn", and the second liquid storage chamber Rb of each circulation head Hn is represented by a symbol "Rb/Hn".

As illustrated in FIGS. 13 to 15, the first supply flow path Sa is a flow path including a first supply portion Pa1, a first connection portion Pa2, and four filter portions Fa_1 to Fa_4. As understood from FIGS. 12 and 15, the first supply portion Pa1 is formed between the first substrate W1 and the second substrate W2. The first supply portion Pa1 has an end portion in the Y2 direction communicating with the first supply port Sa_in and extends in the Y1 direction along the X-Y plane. The first supply portion Pa1 includes a space corresponding to the detection hole O that penetrates the first substrate W1.

As illustrated in FIGS. 12 and 15, the first connection portion Pa2 and the four filter portions Fa_1 to Fa_4 are formed along the X-Y plane between the second substrate W2 and the third substrate W3. As illustrated in FIGS. 13 to 15, the first connection portion Pa2 communicates with the first supply portion Pa1 via a through-hole formed at the communication position Ga1 of the second substrate W2. The communication position Ga1 is a substantially central point of the first supply portion Pa1 in the Y-axis direction. The detection hole O in which the temperature detection element 22 is installed is located in the vicinity of the communication position Ga1. The first connection portion Pa2 extends in the Y2 direction from the communication position Ga1, branches into two systems, and communicates with the filter portion Fa_3 and the filter portion Fa_4.

As illustrated in FIGS. 13 and 15, the filter portion Fa_1 communicates with the first supply portion Pa1 via a through-hole formed in the communication position Ga2 of the second substrate W2. The communication position Ga2 is a point at an end portion of the first supply portion Pa1 in the Y1 direction. The filter portion Fa_2 communicates with the first supply portion Pa1 via a through-hole formed at the communication position Ga3 of the second substrate W2. The communication position Ga3 is a point between the communication position Ga1 and the communication position Ga2 of the first supply portion Pa1. Each filter portion Fa_n communicates with the supply port Ra_in of each circulation head Hn via a through-hole penetrating the third substrate W3, the fourth substrate W4, and the fifth substrate W5.

Figure 16:
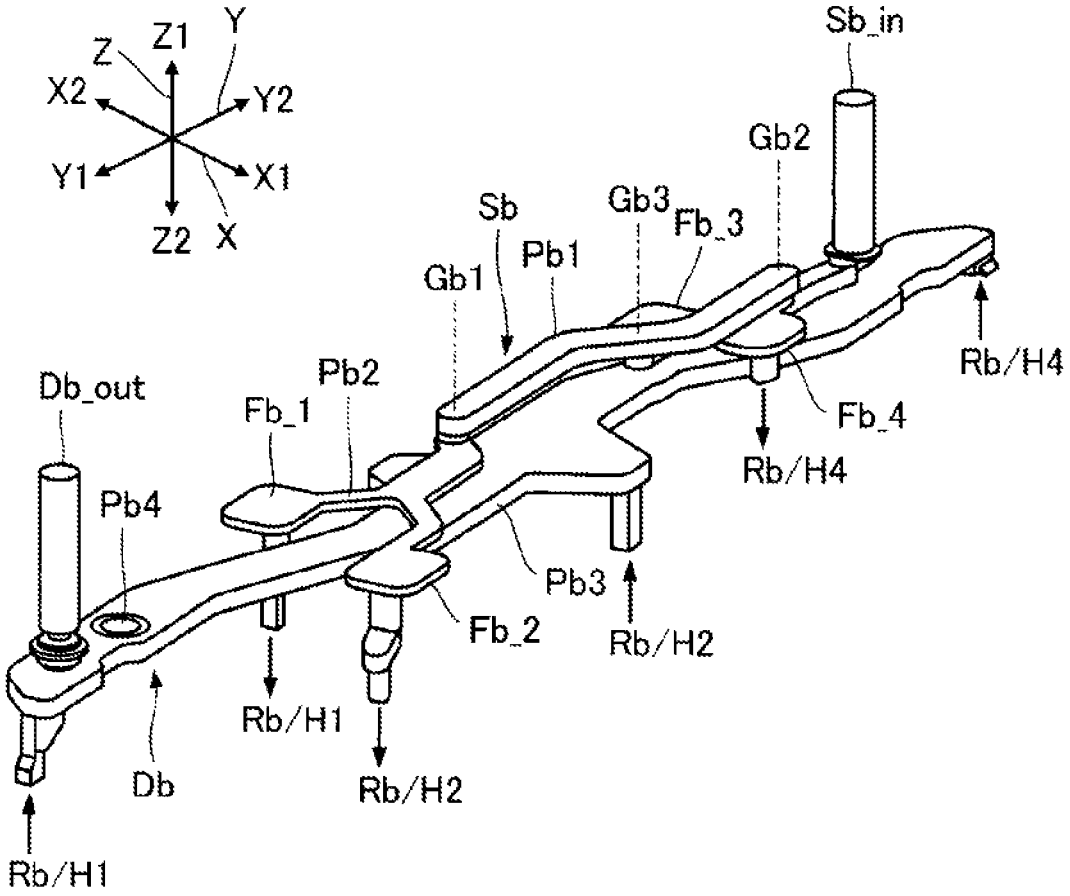
FIG. 16 is a perspective view of a second supply flow path and a second discharging flow path.
Figure 17:
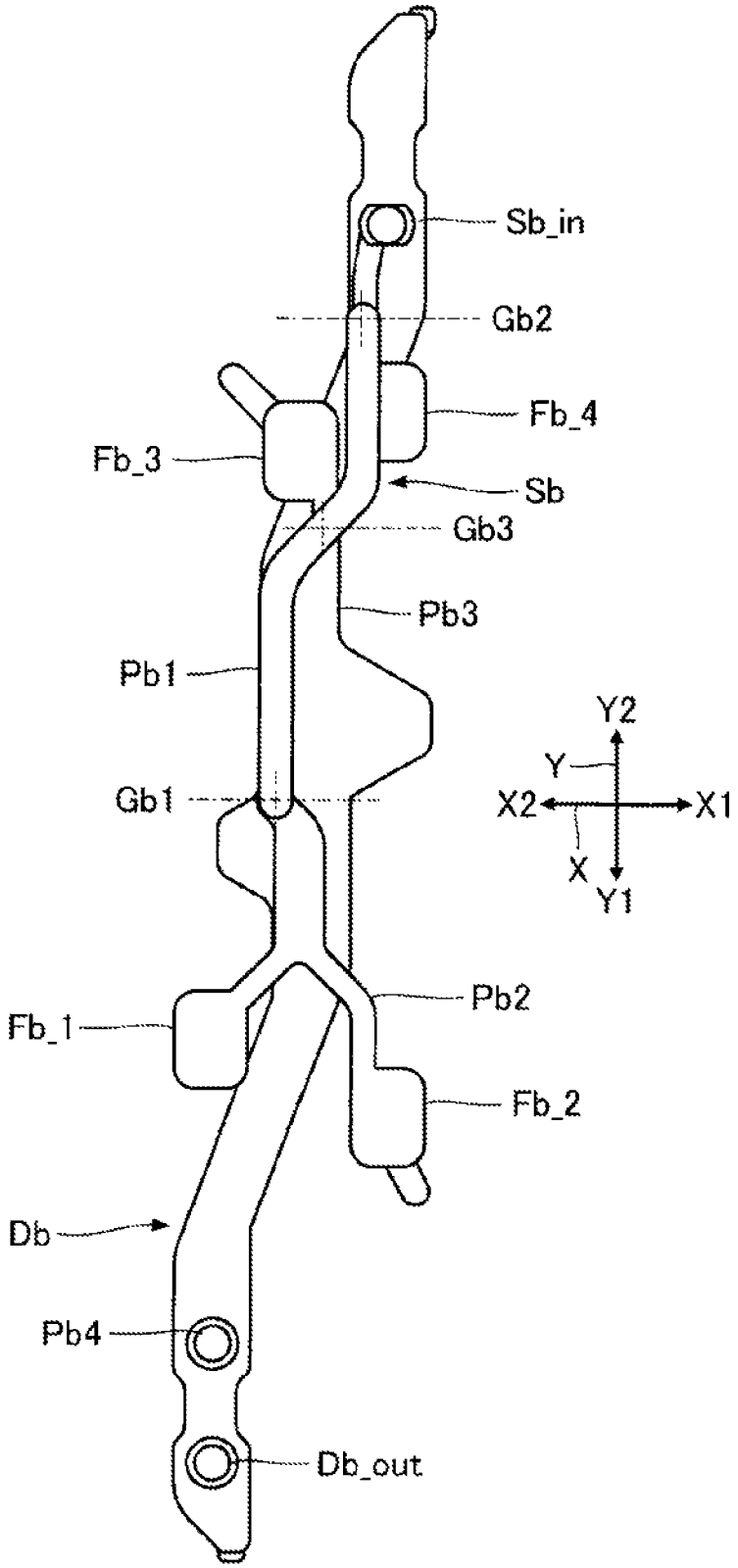
FIG. 17 is a plan view of the second supply flow path and the second discharging flow path.

FIG. 16 is a perspective view in which the second supply flow path Sb and the second discharging flow path Db are extracted. FIG. 17 is a plan view of the second supply flow path Sb and the second discharging flow path Db, and FIG. 18 is a side view of the second supply flow path Sb and the second discharging flow path Db.

Figure 18:
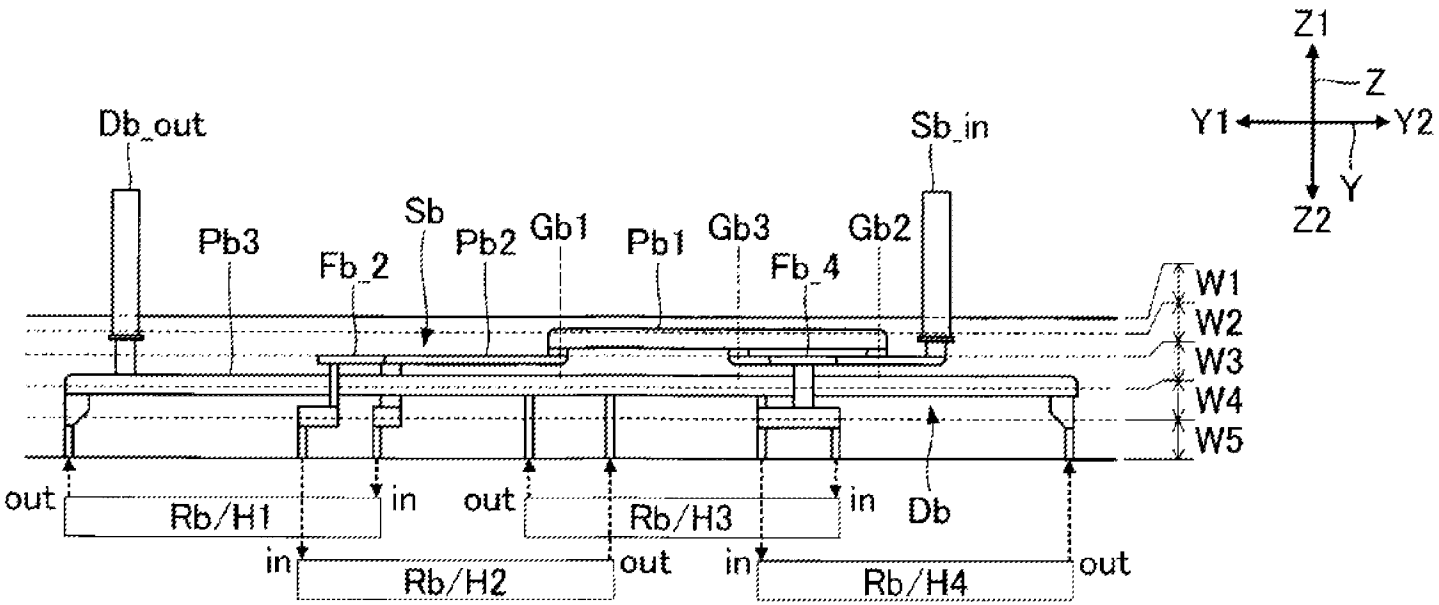
FIG. 18 is a side view of the second supply flow path and the second discharging flow path.

As illustrated in FIGS. 16 to 18, the second supply flow path Sb is a flow path including the second supply portion Pb1, the second connection portion Pb2, and the four filter portions Fb_1 to Fb_4. As understood from FIGS. 12 and 18, the second supply portion Pb1 is formed between the first substrate W1 and the second substrate W2. The second supply portion Pb1 has an end portion in the Y2 direction communicating with the second supply port Sb_in, and extends in the Y1 direction along the X-Y plane. That is, the first supply portion Pa1 and the second supply portion Pb1 are installed in parallel between the first substrate W1 and the second substrate W2. As illustrated in FIGS. 9 and 10, the second supply portion Pb1 is formed along the first supply portion Pa1.

As illustrated in FIGS. 12 and 18, the second connection portion Pb2 and the four filter portions Fb_1 to Fb_4 are formed along the X-Y plane between the second substrate W2 and the third substrate W3. As illustrated in FIGS. 16 to 18, the second connection portion Pb2 communicates with the second supply portion Pb1 via a through-hole formed in the communication position Gb1 of the second substrate W2. The communication position Gb1 corresponds to the end portion of the second supply portion Pb1 in the Y1 direction, and is a point in the vicinity of the communication position Ga1 of the first supply portion Pa1. The second connection portion Pb2 extends in the Y1 direction from the communication position Gb1, branches into two systems, and communicates with the filter portion Fb_1 and the filter portion Fb_2. That is, the second connection portion Pb2 extends from the communication position Gb1 in a direction opposite to the first connection portion Pa2.

As illustrated in FIGS. 16 and 18, the filter portion Fb_4 communicates with the second supply portion Pb1 via a through-hole formed in the communication position Gb2 of the second substrate W2. The communication position Gb2 is a point at the end portion of the second supply portion Pb1 in the Y2 direction. The filter portion Fb_3 communicates with the second supply portion Pb1 via a through-hole formed at the communication position Gb3 of the second substrate W2. The communication position Gb3 is a point between the communication position Gb1 and the communication position Gb2 in the second supply portion Pb1. Each filter portion Fb_n communicates with the supply port Rb_in of each circulation head Hn via a through-hole penetrating the third substrate W3, the fourth substrate W4, and the fifth substrate W5.

As understood from FIG. 11, the filter portions Fa_1 and Fb_1 for the circulation head H1, and the filter portions Fa_2 and Fb_2 for the circulation head H2 are located in the Y1 direction when viewed from the communication position Ga1 or the communication position Gb1. On the other hand, the filter portions Fa_3 and Fb_3 for the circulation head H3, and the filter portions Fa_4 and Fb_4 for the circulation head H4 are located in the Y2 direction when viewed from the communication position Ga1 or the communication position Gb1.

As illustrated in FIGS. 13 to 15, the first discharging flow path Da is a flow path including the first discharging portion Pa3. The first discharging portion Pa3 extends along the X-Y plane in the same manner as the first supply portion Pa1 of the first supply flow path Sa. Specifically, the first discharging portion Pa3 extends along the Y-axis over a wider range than the first supply portion Pa1. The vicinity of the end portion of the first discharging portion Pa3 in the Y1 direction communicates with the first discharging port Da_out. An average value of a flow path area in the first discharging portion Pa3 exceeds an average value of a flow path area in the first supply portion Pa1.

As understood from FIGS. 12 and 15, the first discharging portion Pa3 is formed between the fourth substrate W4 and the fifth substrate W5. When a set of the first substrate W1 and the second substrate W2 is expressed as a first set, and a set of the fourth substrate W4 and the fifth substrate W5 is expressed as a second set, the first supply portion Pa1 is formed between the substrates W of the first set, and the first discharging portion Pa3 is formed between the substrates W of the second set different from the first set. That is, positions of the first supply portion Pa1 of the first supply flow path Sa and the first discharging portion Pa3 of the first discharging flow path Da are different from each other in the Z-axis direction. In other words, the first supply portion Pa1 and the first discharging portion Pa3 may be formed in different layers. The first supply portion Pa1 and the first discharging portion Pa3 partially overlap each other when viewed in the Z-axis direction. The discharging port Ra_out of each circulation head Hn communicates with the first discharging portion Pa3 via a through-hole penetrating the fifth substrate W5.

As described above, the temperature of the first ink in the first discharging flow path Da is lower than the temperature of the first ink in the first supply flow path Sa. Therefore, there is a possibility that the temperature of the first ink in the first supply flow path Sa is lowered due to the low temperature of the first ink in the first discharging flow path Da. In the present embodiment, a position of the first supply portion Pa1 of the first supply flow path Sa and a position of the first discharging portion Pa3 of the first discharging flow path Da are different from each other in the Z-axis direction. Accordingly, even when a distance is secured between the first supply portion Pa1 and the first discharging portion Pa3 to such an extent that a temperature drop in the first supply flow path Sa due to the temperature difference from the first ink in the first discharging flow path Da is sufficiently suppressed, there is an advantage that a size of the liquid ejecting head 252 in a direction parallel to the X-Y plane can be reduced. In the present embodiment, in particular, the first supply portion Pa1 and the first discharging portion Pa3 partially overlap each other when viewed in the Z-axis direction. Therefore, the effects described above are particularly remarkable in that the size of the liquid ejecting head 252 in the direction parallel to the X-Y plane can be reduced as compared with a configuration in which the first supply portion Pa1 and the first discharging portion Pa3 do not overlap each other when viewed in the Z-axis direction.

As illustrated in FIGS. 16 to 18, the second discharging flow path Db is a flow path including the second discharging portion Pb3. The second discharging portion Pb3 extends along the X-Y plane in the same manner as the second supply portion Pb1 of the second supply flow path Sb. Specifically, the second discharging portion Pb3 extends along the Y-axis over a wider range than the second supply portion Pb1. The vicinity of the end portion of the second discharging portion Pb3 in the Y1 direction communicates with the second discharging port Db_out. An average value of a flow path area in the second discharging portion Pb3 exceeds an average value of a flow path area in the second supply portion Pb1.

As understood from FIGS. 12 and 18, the second discharging portion Pb3 is formed between the third substrate W3 and the fourth substrate W4. When the set of the first substrate W1 and the second substrate W2 is expressed as a first set, and the set of the third substrate W3 and the fourth substrate W4 is expressed as a second set, the second supply portion Pb1 is formed between the substrates W of the first set, and the second discharging portion Pb3 is formed between the substrates W of the second set different from the first set. That is, a position of the second supply portion Pb1 of the second supply flow path Sb and a position of the second discharging portion Pb3 of the second discharging flow path Db are different from each other in the Z-axis direction. In other words, the second supply portion Pb1 and the second discharging portion Pb3 may be formed in different layers. Further, the second supply portion Pb1 and the second discharging portion Pb3 partially overlap each other when viewed in the Z-axis direction. The discharging port Rb_out of each circulation head Hn communicates with the second discharging portion Pb3 via a through-hole penetrating the fourth substrate W4 and the fifth substrate W5.

As described above, in the present embodiment, the position of the second supply portion Pb1 of the second supply flow path Sb and the position of the second discharging portion Pb3 of the second discharging flow path Db are different from each other in the Z-axis direction. Therefore, even when a distance is secured between the second supply portion Pb1 and the second discharging portion Pb3 to such an extent that a temperature drop in the second supply flow path Sb due to the temperature difference from the second ink in the second discharging flow path Db is sufficiently suppressed, there is an advantage that the size of the liquid ejecting head 252 in the direction parallel to the X-Y plane can be reduced. In the present embodiment, in particular, the second supply portion Pb1 and the second discharging portion Pb3 partially overlap each other when viewed in the Z-axis direction. Therefore, the effects described above are particularly remarkable in that the size of the liquid ejecting head 252 in the direction parallel to the X-Y plane can be reduced.

In the present embodiment, it is possible to make the position of the first supply portion Pa1 and the position of the first discharging portion Pa3 in the Z-axis direction different from each other, and the position of the second supply portion Pb1 and the position of the second discharging portion Pb3 in the Z-axis direction different from each other by a simple configuration in which a plurality of substrates W are stacked.

As illustrated in FIGS. 10 and 14, a first communication path Pa4 is formed in the first discharging portion Pa3 of the first discharging flow path Da. The first communication path Pa4 is a pipe line which penetrates the first discharging portion Pa3. As illustrated in FIG. 10, the discharging port Rb_out of the circulation head H3 communicates with the second discharging portion Pb3 of the second discharging flow path Db via the first communication path Pa4. Further, as illustrated in FIGS. 16 and 17, a second communication path Pb4 is formed in the vicinity of the second discharging port Db_out in the second discharging portion Pb3 of the second discharging flow path Db. The second communication path Pb4 is a pipe line which penetrates the second discharging portion Pb3. As illustrated in FIG. 9, the first discharging port Da_out communicates with the first discharging portion Pa3 of the first discharging flow path Da via the second communication path Pb4.

As described above with reference to FIG. 12, the first supply portion Pa1 and the first connection portion Pa2 of the first supply flow path Sa, and the second supply portion Pb1 and the second connection portion Pb2 of the second supply flow path Sb are formed by stacking the first substrate W1, the second substrate W2, and the third substrate W3. On the other hand, the first discharging portion Pa3 of the first discharging flow path Da and the second discharging portion Pb3 of the second discharging flow path Db are formed by stacking the third substrate W3, the fourth substrate W4, and the fifth substrate W5.

FIG. 12 illustrates a predetermined position (hereinafter referred to as "reference position") Zref in the Z-axis direction. The reference position Zref is a position between both surfaces of the third substrate W3 and is an example of a "predetermined position". As understood from FIG. 12, the first supply portion Pa1 and the first connection portion Pa2 of the first supply flow path Sa, and the second supply portion Pb1 and the second connection portion Pb2 of the second supply flow path Sb are located in the Z1 direction with respect to the reference position Zref. On the other hand, the first discharging portion Pa3 of the first discharging flow path Da and the second discharging portion Pb3 of the second discharging flow path Db are located in the Z2 direction with respect to the reference position Zref. As described above, in the present embodiment, the first supply portion Pa1 and the second supply portion Pb1, and the first discharging portion Pa3 and the second discharging portion Pb3 are located opposite to each other with respect to the reference position Zref. Further, the first discharging portion Pa3 of the first discharging flow path Da is located between the first supply portion Pa1 of the first supply flow path Sa and each first liquid ejecting portion Qa. Similarly, the second discharging portion Pb3 of the second discharging flow path Db is located between the second supply portion Pb1 of the second supply flow path Sb and each second liquid ejecting portion Qb.

As understood from FIG. 12, the second discharging portion Pb3 of the second discharging flow path Db is located between the first discharging portion Pa3 of the first discharging flow path Da and the first supply portion Pa1 of the first supply flow path Sa, or the second supply portion Pb1 of the second supply flow path Sb. That is, the second discharging portion Pb3 is formed at a position closer to the first supply portion Pa1 and the second supply portion Pb1 than the first discharging portion Pa3.

As a comparative example with the present embodiment, a configuration is assumed in which one or both of the first supply portion Pa1 and the second supply portion Pb1 are located between the first discharging portion Pa3 and the second discharging portion Pb3. In the comparative example, since the ink of a low temperature is located in both the Z1 direction and the Z2 direction with respect to the first supply portion Pa1 or the second supply portion Pb1, there is a possibility that the temperature of the first ink in the first supply portion Pa1 or the temperature of the second ink in the second supply portion Pb1 decreases. Accordingly, in order to supply the ink of a target temperature to the first liquid storage chamber Ra and the second liquid storage chamber Rb, it is necessary to increase a set temperatures of the first heating mechanism 43*a* and the second heating mechanism 43*b*. As a result, there is a problem that power consumption increases.

In contrast to the comparative example described above, in the present embodiment, the first supply portion Pa1 and the second supply portion Pb1, and the first discharging portion Pa3 and the second discharging portion Pb3 are separated from each other with the reference position Zref interposed therebetween. That is, a degree is reduced to which the ink of the low temperature passing through the first discharging portion Pa3 and the second discharging portion Pb3 affects the temperature of the ink in the first supply portion Pa1 and the second supply portion Pb1. Therefore, according to the present embodiment, a possibility can be reduced that the temperature of the ink in the first supply portion Pa1 and the second supply portion Pb1 decreases due to the temperature difference from the first discharging portion Pa3 or the second discharging portion Pb3. Further, according to the configuration described above, since the setting temperature of the first heating mechanism 43*a* and the second heating mechanism 43*b* necessary for supplying the ink of the target temperature to the first liquid storage chamber Ra and the second liquid storage chamber Rb is reduced as compared with that of the comparative example, there is an advantage that the power consumption of the liquid ejecting apparatus 100 can be reduced.

If the temperature drop of the ink in the first discharging portion Pa3 and the second discharging portion Pb3 closer to the first supply portion Pa1 and the second supply portion Pb1 is remarkable, the temperature of the ink in the first supply portion Pa1 and the second supply portion Pb1 tends to decrease. In view of the circumstances described above, in the present embodiment, the second discharging portion Pb3 through which the second ink of the second liquid container 12*b* passes is installed at a position closer to the first supply portion Pa1 and the second supply portion Pb1 than the first discharging portion Pa3 through which the first ink of the first liquid container 12*a* passes. Under the tendency described above that the consumption amount of the second ink is larger than the consumption amount of the first ink, a flow rate of the second ink in the circulation head Hn is larger than a flow rate of the first ink. Accordingly, the temperature drop of the second ink is suppressed as compared with that of the first ink. That is, in the present embodiment, the second discharging portion Pb3, through which the second ink of which the temperature is unlikely to decrease compared to that of the first ink passes, is installed at a position closer to the first supply portion Pa1 and the second supply portion Pb1 than the first discharging portion Pa3. Therefore, the effect described above that the possibility that the temperature of the ink of the first supply portion Pa1 and the second supply portion Pb1 decreases can be reduced is particularly remarkable.

As described above with reference to FIGS. 13 and 14, the average value of the flow path area in the first discharging portion Pa3 exceeds the average value of the flow path area in the first supply portion Pa1. That is, a flow path resistance of the first discharging portion Pa3 is lower than a flow path resistance of the first supply portion Pa1. Therefore, the first ink discharged from the discharging port Ra_out of each circulation head Hn can be smoothly flowed to the first discharging port Da_out in the first discharging portion Pa3. The first ink, which is pressure-fed from the first circulation pump 42*a*, is supplied to the first supply portion Pa1. Therefore, although the flow path resistance of the first supply portion Pa1 exceeds the flow path resistance of the first discharging portion Pa3, the first ink smoothly flows in the first supply portion Pa1.

As described above with reference to FIGS. 16 and 17, the average value of the flow path area in the second discharging portion Pb3 exceeds the average value of the flow path area in the second supply portion Pb1. That is, the flow path resistance of the second discharging portion Pb3 is lower than the flow path resistance of the second supply portion Pb1. Therefore, the second ink discharged from the discharging port Rb_out of each circulation head Hn can smoothly flow to the second discharging port Db_out in the second discharging portion Pb3. Since the second ink, which is pressure-fed from the second circulation pump 42*b*, is supplied to the second supply portion Pb1, the second ink smoothly flows in the second supply portion Pb1.

Figure 19:
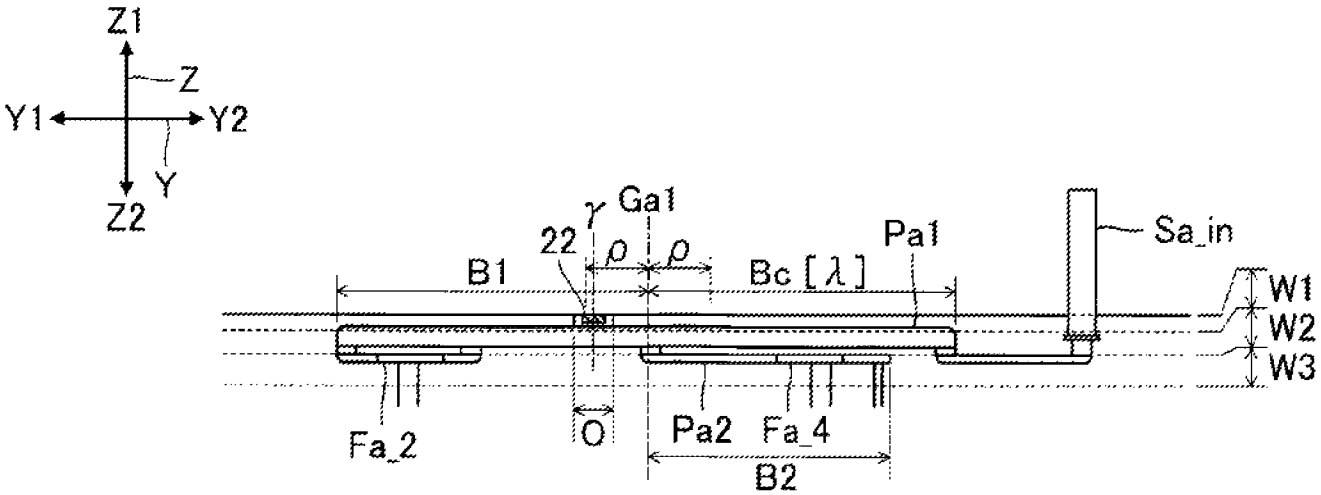
FIG. 19 is an explanatory view of a relationship between the temperature detection element and the flow path of the flow path structure.

Next, a relationship between the temperature detection element 22 and the flow path of the flow path structure 31 will be described with reference to FIG. 19. As illustrated in FIG. 19, a portion (hereinafter referred to as "common portion") Bc of the first supply portion Pa1 of the first supply flow path Sa, which is located in the Y2 direction as viewed from the communication position Ga1, is a common flow path for the four circulation heads H1 to H4. That is, the first ink that has passed through the common portion Bc is distributed to the four circulation heads H1 to H4.

The first supply flow path Sa branches from the common portion Bc into a first branch portion B1 and a second branch portion B2 at the communication position Ga1. The first branch portion B1 is a portion located in the first supply portion Pa1 in the Y1 direction when viewed from the communication position Ga1. The first branch portion B1 communicates with the common portion Bc at the communication position Ga1. The first branch portion B1 is a flow path for supplying the first ink from the common portion Bc, to the first liquid ejecting portion Qa of each of the circulation head H1 and the circulation head H2. The first liquid ejecting portion Qa of the circulation head H1 or the circulation head H2 is an example of the "first liquid ejecting portion".

The second branch portion B2 is the first connection portion Pa2 described above. Similar to the first branch portion B1, the second branch portion B2 communicates with the common portion Bc at the communication position Ga1. The second branch portion B2 is a flow path for supplying the first ink from the common portion Bc, to the first liquid ejecting portion Qa of each of the circulation head H3 and the circulation head H4. The first liquid ejecting portion Qa of the circulation head H3 or the circulation head H4 is an example of the "second liquid ejecting portion".

As illustrated in FIG. 19, the detection hole O penetrating the first substrate W1 is provided in the vicinity of the communication position Ga1 that branches from the common portion Bc to the first branch portion B1 and the second branch portion B2. As described above, the temperature detection element 22 is installed inside the detection hole O. Therefore, the temperature detection element 22 is installed in the vicinity of the communication position Ga1. Specifically, a center of gravity γ of the temperature detection element 22 as viewed in the Z-axis direction is located within a circular range having a radius p centered on the communication position Ga1. The radius ρ is, for example, ⅕ of a total length λ of the common portion Bc. The total length λ of the common portion Bc is a distance between the end portion of the common portion Bc in the Y2 direction located in the upstream region and the communication position Ga1 located in the downstream region. Further, the temperature detection element 22 is located in the upstream region of each filter portion Fa_n installed for each circulation head Hn.

As described above, in the present embodiment, the temperature detection element 22 is installed in the vicinity of the communication position Ga1 where the first branch portion B1, the second branch portion B2, and the common portion Bc communicate with each other, so that it is not necessary to install the temperature detection element 22 individually for each circulation head Hn. Therefore, the configuration of the liquid ejecting head 252 can be simplified.

As described above, in the present embodiment, the second supply portion Pb1 of the second supply flow path Sb is formed along the first supply portion Pa1 of the first supply flow path Sa. Therefore, the measured temperature measured by the temperature detection element 22 is a numerical value reflecting not only the temperature of the first ink in the first supply flow path Sa but also the temperature of the second ink in the second supply flow path Sb. That is, according to the present embodiment, there is an advantage that the temperature of the ink of the second supply flow path Sb as well as the first supply flow path Sa can be measured by one temperature detection element 22. The first liquid ejecting portion Qa or the second liquid ejecting portion Qb of each circulation head Hn to which the second ink is supplied by the second supply flow path Sb is an example of the "third liquid ejecting portion".

The embodiment illustrated above can be variously modified. Specific modifications that can be applied to the embodiment described above will be exemplified below. Two or more aspects any selected from the following examples can be appropriately combined as long as they do not contradict each other.

(1) In the embodiment described above, the first substrate W1 on which the temperature detection element 22 is installed in the flow path structure 31 may be formed of a material having higher thermal conductivity than that of the substrates W (W2 to W5) other than the first substrate W1. According to the configuration described above, the temperature of the ink in the first supply flow path Sa and the second supply flow path Sb can be measured with high accuracy.

(2) In the embodiment described above, different types of ink are supplied to the first supply flow path Sa and the second supply flow path Sb. However, the same type of ink may be supplied to the first supply flow path Sa and the second supply flow path Sb.

(3) In the embodiment described above, the serial type liquid ejecting apparatus that causes the transport body 241 on which the liquid ejecting head 252 is mounted to reciprocate is exemplified. However, the present disclosure can also be applied to a line-type liquid ejecting apparatus in which a plurality of nozzles N are distributed over an entire width of the medium 11.

(4) The liquid ejecting apparatus exemplified in the embodiment described above can be employed in various apparatuses such as a facsimile apparatus and a copying machine in addition to the apparatus dedicated to printing. In addition, the use of the liquid ejecting apparatus is not limited to printing. For example, a liquid ejecting apparatus that ejects a solution of a color material is used as a manufacturing apparatus that forms a color filter of a display device such as a liquid crystal display panel. In addition, a liquid ejecting apparatus that ejects a solution of a conductive material is used as a manufacturing apparatus that forms wiring and an electrode of a wiring substrate. In addition, a liquid ejecting apparatus that ejects an organic solution related to a living body is used as a manufacturing apparatus for manufacturing, for example, a biochip.

What is claimed is:

1. A liquid ejecting head comprising:
- a first liquid ejecting portion configured to eject a liquid;
- a second liquid ejecting portion configured to eject the liquid;
- a first supply flow path configured to supply the liquid to the first liquid ejecting portion and the second liquid ejecting portion;
- a flow path structure in which the first supply flow path is formed; and
- a temperature detection element for measuring a temperature of the liquid, wherein
- the first supply flow path includes
- a common portion to which the liquid is supplied;
- a first branch portion that communicates with the common portion at a communication position, and that supplies the liquid from the common portion to the first liquid ejecting portion; and
- a second branch portion that communicates with the common portion at the communication position, and that supplies the liquid from the common portion to the second liquid ejecting portion,
- the temperature detection element is disposed at a vicinity of the communication position,
- the flow path structure is configured by stacking substrates,
- the first supply flow path is formed between a first substrate located in an outermost layer of the substrates and a second substrate adjacent to the first substrate, and
- the temperature detection element is disposed on the first substrate.

2. The liquid ejecting head according to claim 1, further comprising:

a wiring substrate including a first surface on which a connector to which a signal for driving the first liquid ejecting portion is supplied is disposed, and a second surface on which the temperature detection element is disposed, wherein the wiring substrate is disposed so that the second surface faces the first substrate.

3. The liquid ejecting head according to claim 1, wherein the first substrate is formed of a material having a higher thermal conductivity than that of a substrate other than the first substrate among the substrates.

4. The liquid ejecting head according to claim 2, wherein the first substrate is formed of a material having a higher thermal conductivity than that of a substrate other than the first substrate among the substrates.

5. The liquid ejecting head according to claim 1, further comprising:

a third liquid ejecting portion configured to eject a second liquid; and a second supply flow path configured to supply the second liquid to the third liquid ejecting portion, wherein the second supply flow path is formed along the first supply flow path.

6. The liquid ejecting head according to claim 2, further comprising:

a third liquid ejecting portion configured to eject a liquid; and a second supply flow path configured to supply the liquid to the third liquid ejecting portion, wherein the second supply flow path is formed along the first supply flow path.

7. The liquid ejecting head according to claim 3, further comprising:

a third liquid ejecting portion configured to eject a liquid; and a second supply flow path configured to supply the liquid to the third liquid ejecting portion, wherein the second supply flow path is formed along the first supply flow path.

8. A liquid ejecting apparatus comprising:

the liquid ejecting head according to claim 1; and an ejecting controller controlling ejecting of the liquid by the liquid ejecting head.

9. A liquid ejecting head comprising:

a first liquid ejecting portion including a first drive element and configured to eject a liquid by driving the first drive element;

a second liquid ejecting portion including a second drive element and configured to eject the liquid by driving the second drive element;

a first supply flow path configured to supply the liquid to the first liquid ejecting portion and the second liquid ejecting portion;

a temperature detection element for measuring a temperature of the liquid;

a wiring substrate;

a first coupling portion for electrically coupling the first liquid ejecting portion to the wiring substrate; and a second coupling portion for electrically coupling the second liquid ejecting portion to the wiring substrate, wherein the temperature detection element is provided on a portion different from the first coupling portion and the second coupling portion, the first supply flow path includes a common portion to which the liquid is supplied;

a first branch portion that communicates with the common portion at a communication position, and that supplies the liquid from the common portion to the first liquid ejecting portion; and a second branch portion that communicates with the common portion at the communication position, and that supplies the liquid from the common portion to the second liquid ejecting portion, and the temperature detection element is disposed at a vicinity of the communication position wherein the temperature detection element is provided on the wiring substrate.

10. The liquid ejecting head according to claim 9, further comprising a connector to which a signal for driving the first liquid ejecting portion is supplied.

11. The liquid ejecting head according to claim 10, wherein the wiring substrate including a first surface on which the connector is disposed and a second surface that is opposite from the first surface and that the temperature detection element is disposed.

12. The liquid ejecting head according to claim 10, wherein a wiring length from the connector to the temperature detection element is shorter than a wiring length from the connector to the first ejecting portion.

13. The liquid ejecting head according to claim 10, wherein the first coupling portion includes a rigid wiring substrate.

14. The liquid ejecting head according to claim 10, wherein the first coupling portion includes a flexible wiring substrate.

15. The liquid ejecting head according to claim 10, wherein the first coupling portion includes a rigid wiring substrate and a flexible wiring substrate.

16. A liquid ejecting apparatus comprising:

the liquid ejecting head according to claim 9; and an ejecting controller controlling ejecting of the liquid by the liquid ejecting head.

* * * * *